United States Patent [19]

Ward

[11] Patent Number: 4,774,914

[45] Date of Patent: Oct. 4, 1988

[54] ELECTROMAGNETIC IGNITION—AN IGNITION SYSTEM PRODUCING A LARGE SIZE AND INTENSE CAPACITIVE AND INDUCTIVE SPARK WITH AN INTENSE ELECTROMAGNETIC FIELD FEEDING THE SPARK

[75] Inventor: Michael A. V. Ward, Arlington, Mass.

[73] Assignee: Combustion Electromagnetics, Inc., Arlington, Mass.

[21] Appl. No.: 885,961

[22] Filed: Jul. 15, 1986

Related U.S. Application Data

[63] Continuation-in-part of Ser. No. 779,790, Sep. 24, 1985, abandoned.

[51] Int. Cl.[4] ..... F02P 15/04; F02P 15/08; F02P 3/08

[52] U.S. Cl. ..... 123/162; 123/169 FL; 123/169 MG; 123/598; 123/620; 123/633; 123/634; 123/636

[58] Field of Search ..... 123/143 B, 143 C, 162, 123/169 EL, 169 MG, 210, 536, 596, 598, 604–608, 620, 621, 633, 634, 636, 637, 661; 313/134; 336/221, 222

[56] References Cited

U.S. PATENT DOCUMENTS

| | | | |
|---|---|---|---|
| 2,253,204 | 8/1941 | Lucci | 123/162 |
| 2,253,531 | 8/1941 | Peters et al. | 123/633 X |
| 2,565,198 | 8/1951 | Boyer | 123/143 B |
| 2,617,841 | 11/1952 | Linder . | |
| 2,833,265 | 5/1958 | Hindle et al. | 123/661 |
| 3,349,760 | 10/1967 | Horan | 123/162 |
| 3,739,753 | 6/1973 | Burley et al. | 123/169 EL X |
| 3,754,534 | 8/1973 | Burley . | |
| 3,871,349 | 3/1975 | Hager | 123/169 EL |
| 3,926,165 | 12/1975 | Merrick | 123/636 |
| 3,934,570 | 1/1976 | Asik et al. | 123/598 |
| 4,078,534 | 3/1978 | Mayer | 123/633 |
| 4,136,659 | 1/1979 | Smith | 123/598 |
| 4,194,486 | 3/1980 | Satow et al. | 123/169 EL X |
| 4,297,983 | 11/1981 | Ward | 123/536 |
| 4,356,807 | 11/1982 | Tokura et al. | 123/637 X |
| 4,510,915 | 4/1985 | Ishikawa et al. | 123/620 |
| 4,561,406 | 12/1985 | Ward | 123/536 |
| 4,568,855 | 2/1986 | Nemeth et al. | 313/134 X |

FOREIGN PATENT DOCUMENTS

| | | | |
|---|---|---|---|
| 0391500 | 11/1932 | Belgium . | |
| 0667725 | 10/1929 | France . | |
| 2330877 | 6/1977 | France . | |
| 2479911 | 10/1981 | France . | |
| 2133994 | 2/1973 | Fed. Rep. of Germany | 123/608 |
| 2136874 | 9/1984 | United Kingdom . | |

*Primary Examiner*—Willis R. Wolfe, Jr.
*Attorney, Agent, or Firm*—Jerry Cohen

[57] ABSTRACT

An Electromagnetic Ignition system suitable for adaptation to standard automobile engines including diesel engines, which has been improved by means of a high efficiency RF capacitive spark plug with a projecting antenna tip used for forming very large spark gaps to the plug shell and piston face as well as for coupling high electric fields to the local initial flame plasma, preferably used in combination with shielded high voltage cable including series inductive choke elements and a Capacitive Discharge ignition system incorporating an input capacitor, a SCR switch, an ignition coil with an optimized high current and high output voltage, and preferably a synchronous DC-DC power converter providing "boost power" during ignition so that substantial capacitive, inductive, and electromagnetic energy is supplied to the air-fuel mixture. Preferably the coil has a turns ratio of 50 with the input capacitor having a capacitance between 5 and 10 microfarads and a 400 volts rating. Large output capacitance is provided naturally by existing coil and shielded cable capacitance, supplemented with large plug capacitance of 50 to 250 picofarads, which are charged up to between 15 and 30 Kilovolts prior to breakdown of the wide variable spark gap producing: high frequency capacitive sparks, large inductive spark of several amps; and high pulsed local EM electric field strength of thousands of volts/cm providing a practical, highly efficient ignition system capable of igniting very lean air-fuel mixtures for reducing exhaust emissions and increased engine efficiency.

58 Claims, 8 Drawing Sheets

Post-breakdown
Electric Field
102a
96b
97
94
96a
105
106a
104
109
Flame
Fronts

108
$\epsilon_r$
95
2d
a
b
Ltr
94
96b
96c
96a
97
105
104
Electric
/Current
102a
102
101
107
107a
106a
106
103
h
$L_c$
100

ELECTROMAGNETIC IGNITION—AN IGNITION SYSTEM PRODUCING A LARGE SIZE AND INTENSE CAPACITIVE AND INDUCTIVE SPARK WITH AN INTENSE ELECTROMAGNETIC FIELD FEEDING THE SPARK

CROSS REFERENCE TO RELATED APPLICATIONS

This application is a continuation-in-part of U.S. application Ser. No. 779,790, filed Sept. 24, 1985, now abandoned, the entire disclosure of which is incorporated herein by reference as though set out at length herein; portions of said disclosure are repeated here for emphasis and/or convenience.

BACKGROUND OF THE INVENTION AND PRIOR ART

During the past seventy years work has been performed on ignition systems for internal combustion engines with the objective of improving the ability of the ignition system to ignite the air-fuel mixture. During the past twenty years much of this work has focussed on improving the ability of ignition systems for igniting very lean mixtures, because such mixtures are inherently cleaner burning, and lead to higher engine operating efficiency.

Most of the work which has been performed falls into two distinct categories: active systems in which there is an actual introduction of additional fuel or chemically active species, such as in the Honda CVCC engine where additional fuel is introduced through an additional valve, or as in continuous (flowing) plasma jets as exemplified by Hilliard and Weinberg, Nature 259 (1976); and passive systems in which there is no actual introduction of additional fuel or chemical species, but rather the creation of new species or new levels of activation by means of spark or other plasma discharges. The predominant and by far simpler type of system is the passive system, the development of a novel type of which is disclosed in this patent application and in my prior U.S. patent application Ser. No. 779,790, now abandoned.

A problem of improving ignition is one of identifying the elements important in ignition and then working to optimize them. There is considerable disagreement on what these elements are. Furthermore, even if they are agreed upon, it is unclear how to create an ignition which both produces these elements and which can then appropriately distribute the energy between or among them. The present invention identifies all the elements and provides a method and system which allows such elements to be excited in an optimal way and a way that can be simply varied to accomodate for differing internal combustion engine environments.

Two of the three elements of ignition are discussed by Taylor Jones "Induction Coil, Theory and Application", Isaac Pitman & Sons, London, 1932, Chapter VIII, "Spark Ignition". Taylor Jones discusses the "Ignition by Capacity and by Inductance Sparks" and shows how the two components can behave differently under different conditions. To quote: "The condenser produces a decided diminution in the igniting power of the spark, and the inferiority of the condenser spark with the spherical electrodes is quite as marked as its superiority when the electrodes are metal points".

In a classic paper "The mechanism of Ignition by Electric Discharges", circa 1935, Bradford and Finch investigate the two phenomena (capacitive and inductive sparks) with reference to the "thermal versus electrical theories of ignition" and again show that the igniting ability of the two componets varies with the circumstance in which they are used. In their discussion they indirectly introduce a third element, namely "excited states". They argue that "the necessary prerequisite for the ignition of an explosive gaseous mixture was the setting up of a sufficient concentration of suitably activated molecules, and . . . ignition by electrical discharge depended on this specific activation and not on the fully degenerate activation associated with thermal energy, as postulated by the thermal theory of ignition." This statement identifying this third factor (intermediate excited states) is at odds with Taylor Jones. Recently, Maly et al, SAE Paper 830478, 1983, "Prospects of Ignition Enhancement" argue that only the capacitive of the three elements is important, while the body of work on plasma jet ignition indicates otherwise.

Generally speaking, the first or capacitive element or component is enhanced by adding a capacitor between the ignition coil high voltage output and ground, as disclosed by all of the above authors, and more recently directly or indirectly by Fitzegerald (U.S. Pat. No. 4,122,816), Ward (U.S. Pat. No. 4,317,068), Anderson and Asik (U.S. Pat. No. 4,487,192), and others. The second or inductive component is enhanced in numerous ways, as in plasma jet ignition (U.S. Pat. Nos. 4,122,816 and 4,317,068 given above), or in more conventional ignitions, such as Ward, U.S. Pat. No. 4,677,960, where a special coil design is used to produce a large inductive component.

The third element and a means to excite it are disclosed in U.S. Pat. Nos. 3,934,566 and 4,138,980, where the concept of electromagnetically stimulated combustion is introduced. The concept here is to maintain a high frequency oscillating electric field of strength of order 1,000 volts/cm/atmosphere at the region of the ignition and flame plasma to excite intermediate molecular levels there. In the above U.S. Pat. No. 4,138,980, Ward discloses means to "ground the spark to the piston face" as well as means "wherein said rf energy is conducted (from an external RF generator) to said chamber through said spark plug".

The present invention discloses that all three elements are important and discloses a system to excite them in conjunction with a large size spark. A preferred system uses a modified form of spark plug—a capacitive plug with an antenna tip—to form a spark to the plug shell and/or piston face and to couple high amplitude electric fields through the spark plug. The fields are generated prior to spark breakdown (and during plug "firing/non-sparking"), and also upon breakdown (spark formation) by converting essentially high voltage DC energy stored in a modified plug to high frequency EM energy which is automatically resonantly stored in the plug and combustion chamber independent of the piston motion (or motion of other opposing movable member, such as the rotor in the Rotary Wankel Engine). The capacitive energy element is preferably stored in the spark plug, while the inductive element is produced by a slight variant of the capacitor and coil combination as disclosed in U.S. Pat. No. 4,677,960, referred to henceforth also as the "CDC ignition" system.

OBJECTS OF THE INVENTION

It is a principal object of this invention to use a high energy capacitive discharge (CD) ignition system in conjunction with a special ignition coil (CDC system) with high output capacitance on coil secondary side provided in part by a novel capacitive plug with a tip (an antenna) projecting well into the combustion chamber to define a large and variable spark gap which forms unusually large and intense sparks to the plus shell and/or to the piston face to provide an Electromagnetic Ignition (EM Ignition) characterized by the three spark components identified as the critical ones for lean mixture combustion: the capacitive component, the inductive component, and the very high electric field component or electromagnetic (EM) component.

Another object of this invention is to provide such an EM Ignition system which is simple and practical and easy to install on existing engines, and which produces the desired EM Ignition effects by using a simple DC-DC converter, low loss discharge capacitors and solid state switches, e.g. SCR's, and a low turns ratio high efficiency coil (defining the CDC system), and a high efficiency "EM" (or "RF") spark plug capable of storing significant capacitive energy; and to provide such a system able to transform the energy provided by the CDC system effectively to capacitance and inductive sparks and to EM (electric field) energy in the region of the initial flame by using a projecting antenna spark plug tip and firing the spark to the plug shell and/or the piston face where practical.

It is another object of this invention to make use of the inherent transient voltage doubling characteristic of a transformer (ignition coil) used in conjunction with a CD circuit (the CDC system) to provide high output voltage of 30 Kilovolts when a high output capacitance of 300 picofarads of the EM Ignition system loads the secondary high voltage circuit, and to simultaneously provide high currents and high energy transfer efficiency by proper use of minimal possible coil turns ratio (e.g. 50), optimal wire size, and highest CD system oscillation frequency (of about 12 KHz) chosen consistently with providing lowest SCR conduction forward drop and reliable SCR turn-off.

It is another object of this invention to provide an ignition "sparking profile" characterized by an initial high breakdown spark voltage for a large initial capacitance spark followed by a large oscillating sine wave current (the inductive spark) lasting for several sine waves (termed "ringing spark"), followed by closely spaced single sine wave "sparks" formed to the spark plug shell and/or the piston face to create very high local electric fields due to the high voltage rise and/or the "firing non-sparking" of the plug, and/or to create periods of high frequency EM oscillations with high electric field component in the locality of the ignition kernel and initial flame.

Another object is to provide such an EM Ignition system with low EM Interference (EMI) by reactively limiting EM radiation and by using shielding.

Another object is to provide an EM spark plug design which incorporates a high intrinsic capacitance (50 to 250 picofarads) and very low EM insulator losses and metal conductive EM losses, and an extended insulated central high voltage conductor such that it can fire a wide spark gap to the piston face under a wide range of engine operating conditions, and allow the high capacitive EM currents to persist because of its very low EM losses.

Another object is to provide such an EM spark plug which has a large diameter and small length such that when the spark is formed to the piston face, the EM field phase angle (of 90 degrees total phase angle) at the spark kernel is as small as practical with reference to the coil end of the EM plug, and the coil end of the plug presents a large impedance mismatch to the outside.

Another object is to make the plug end as large diameter as is practical so that it provides the additional benefit of producing squish with the piston at the top dead center (TDC) position and thus pushes the hot gases outwards. In conjunction with such large diameter plug ends it is also an object, where practical, to bring the high voltage electrode to a point so that it focusses the electric field onto the piston face.

Other objects are to use the EM plug with special piston designs, such as ones that are indented at the spark plug tip to allow for advanced timing under high load conditions, and ones that have interrupted electrically conductive paths on their surface to produce several in-series spark firing sites upon firing of the ignition.

Another object is to use a "piston" grounded spark in conjunction with a rotor of a rotary or Wankel engine preferably modified at the rotor TDC site to provide optimized spark ignition characteristics with timing advance and load setting.

Another object is to use a ceramic insulating layer at the edge of the combustion chamber in conjunction with the piston grounded spark such that the region of maximum current is shifted from the piston-cylinder interface to a metallic wall containing the ceramic insert.

Another object is to limit EM interference (EMI) and deliver the secondary capacitive energy to the spark by interposing an inductor in the secondary side of the coil to reduce the capacitive spark oscillation frequency generated by the coil output capacitance and the King lead capacitance to in between 2 and 20 MHz, and including magnetic absorbing material in the king lead to absorb EMI generated above 20 MHz produced at the instant of breakdown of the distributor rotor tip and the spark gaps.

Another object is to place some of the interposing secondary inductance in the insulating cavity of the capacitive plugs isolated from the plug capacitor itself such that the secondary non-plug capacitive energy is controllably delivered to the spark, especially the spark plug cable capacitive energy which would normally radiate, and to further insure that all the plug capacitive energy is delivered to the spark because of the large impedence in the non-spark plug tip direction.

Another object is to provide maximum plug capacitance and minimal EM resistance in the capacitive plug by either electroless plating the ceramic surfaces of the capacitive portion of the plug with high electrical conductivity material, e.g. silver, or gluing high conductivity foil to the surfaces so that plug roundness is not necessary for providing high capacitance, and very low resistive losses are thus also simultaneously provided.

Another object is to provide a spark plug tip and orientation such that under most operating conditions the spark forms both to the shell of the plug and to a side if a sidewall exists, and to the piston face during one spark plug firing.

Another object is to limit EMI while providing the maximum practical capacitive spark by keeping the low sides of the ignition coil windings seperated, and making the low side of the secondary winding a part of the EMI shield.

Another object is to design the projecting plug (antenna) tip such that it couples high electric fields to the largest volume possible around the plug tip and for the longest duration, where the long duration is attained by insuring a long high voltage rise time (because of high output capacitance) and the high fields are attained by insuring a high value of breakdown voltage just prior to spark breakdown.

Another object is to design the sparking wave profile so that certain pulsing cycles following the initial spark are firing but "non-sparking" cycles and thus produce very high local electric fields within a large volume around the plug tip (a large "EM Control Volume") when used in conjunction with an antenna type projecting plug tip.

Another object is to generate upon spark firing a sequence of at least three seperate current waveforms delivering electrical power to the spark at the rates of the order of 100 Kilowatts, followed by 10 Kilowatts, followed by one Kilowatt at frequencies of the order of 100 MHz, 10 MHz, and 10 KHz respectively, where the "order of" in this context means between 1/5 and 5 times the value quoted; said waveforms generated by sequential and controlled (by means of inductors) dumping of capacitive energy stored in the spark plug and/or spark plug wires, stored in the output capacitance of the coil and/or across the coil output, and stored in the capacitor of the preferably CDC circuit.

Another object is to use sufficiently high conductivity material in the various parts of the ignition circuit such that the 100, 10, and 1 Kilowatt energy delivery to the spark last for periods that fall at the minimum in the ranges of 0.1–1 usecs, 1–10 usecs, and 10–100 usecs respectively.

Another object is to provide series multiple spark firing sites on the piston face by providing electrically coductive islands insulated with ceramic from the piston face and forming series gaps gi of capacitance Cij between gaps, and island to piston capacitances Cgi such that the gap capacitances Cij are much less than capacitances of the islands to the piston body Cgi. Preferably the surfaces making up Cgi are plated with high electrical conductivity material such as silver.

Another object is to construct the piston (for providing multiple spark gaps) with a top part made of material with low thermal expansion coefficient e.g. iron or titanium, so that the ceramic coating (insulating the islands providing piston spark gaps) is thermally better matched to the base metal. Preferably a thin coating of high electrically conductive material, e.g. 0.001 to 0.01 inch silver plate is sandwiched between the ceramic and metallic surfaces.

Another object is to provide an inductor Ls in series with the secondary high voltage output to provide secondary voltage doubling when more than one spark gap is present. Criteria for the value of Ls and the ith spark gap to ground capacitance Cgi are given in terms of the "formative" spark time constant and voltage doubling factor so that an increased voltage is provided to fire the spark gaps following the initial plug tip gap.

Other features and advantages will be pointed out hereinafter, and will become apparent from the following discussion including a Summary of the invention and Description of Particular Preferred Embodiments of the invention when read in conjunction with the accompanying drawings.

SUMMARY OF THE INVENTION

This invention comprises certain novel ignition system components used in a novel combination to provide a simple, practical, and retrofitable unitary ignition-combustion support system, able to provide outstanding ignition capabilities by producing, in a highly efficient way and consistent with a large dimension spark, the three key elements required for igniting and sustaining the combustion of very lean air-fuel mixture: large capacitive spark components, a large inductive component, and high electric fields (low to moderate frequency and high frequency electromagnetic (EM) field components) which are maintained in the combustion chamber in the vicinity of both the ignition and the flame plasma kernel independent of the chamber shape or of the piston motion.

The importance of having high energy in all three components is as follows: When the spark is formed, the very large and intense capacitive spark component insures that a viable flame kernel is formed under extreme ranges of conditions (including very lean air-fuel mixture conditions). The inductive component which follows the capacitive spark component creates a large high temperature volume or plume around the initial intense, very high temperature capacitive spark, so the flame kernel leaving the capacitive spark now moves through a high temperature gas which is hot enough to be ignited by the moving kernel. The inductive component by itself may not be sufficiently hot to cause ignition. The EM component (electric field) associated with the initial and subsequent spark breakdowns feeds EM energy to the developing flame kernel (and to the capacitive and the inductive component). In this way, instead of moving into a cold gas and rapidly quenching, the kernel launched by the capacitive component moves through a preconditioned hot gas, which when combined with the large gap initial spark and high electric field assist, creates a very large initial viable kernel which is critical to ignition.

The system to create this kind of an ignition is composed of:

(1) a high efficiency high output DC-DC power converter, preferably a novel "simple synchronous current pump", (2) a high efficiency discharge circuit (a CDC circuit) made up of a large discharge capacitors with high efficiency switches, such as bistable semiconductor devices (e.g. SCRs), (3) novel, low turns ratio, very high efficiency ignition coil, (4) an ignition controller, (5) high voltage, high capacitance, low EM resistance spark plug with a protruding tip (an antenna) behaving in part as a short section of transmission line terminated in a short antenna, which is preferably designed to form a large spark gap to the spark plug shell and piston face, (6) shielding material and tuning inductors (chokes) to control the high voltage capacitive components so they produce minimum EMI and maximum EM field strength and sparking benefit.

The invention includes use of a CD circuit (CDC circuit) with ignition coil/capacitor "voltage doubling" consistent with the a high output (e.g. spark plug) capacitance providing large capacitive and large inductive spark energy, i.e. use of large CDC capacitor (10 ufarads) to handle the high output capacitance (e.g. 300 picofarads). Large gap ignition of preferably minimum 15 Kilovolts breakdown voltage is used for high capacitive spark components, and an initial continuous or "ringing" continuous sine wave spark is used to provide a large initial inductive spark, followed by closely spaced "single sine wave" high breakdown voltage multiple sparks to generate several types of EM fields with very high electric field components coupled by means of the antenna plug tip to the vicinity of the large initial spark and the ensuing flame. In this combination, the EM Ignition system provides an optimized and practical ignition system able to provide ignition of ultra lean mixtures.

An important feature of EM Ignition is that by forming the spark to the plug shell and piston face it provides spark gaps in excess of 0.1" and up to 0.25" or even greater in length. When firing to the piston multiple sparks can be produced by interposing insulating layers along the current path. Under part load, very lean mixture conditions, where the ignition timing is well advanced (and the spark plug piston face gap is thus large while the ambient engine pressures are low), firing will occur either to the plug shell defining a large gap (e.g. 0.25") or to the piston face under precisely the conditions where a large spark is most needed. Under cranking conditions where the cylinder pressures are high a smaller gap is available by the proximity of the piston since the timing is retarded (close to TDC). Under full load, high RPM conditions (where the pressures are both high and the spark gap is moderately large) the combination of high output voltage (e.g. 33 Kilovolts) and moderate pressures will insure firing of the spark plug.

The high frequency EM fields are generated through rapid, large gap firing of the capacitive plug onto the piston face (following the initial ringing spark) which resonantly excites the entire combustion chamber since the spark current is forced to "return" along the interior of the piston face and cylinder head (which path can be increased by including a ceramic insert in the head). Typically, the time between firings is of order 100 microseconds (usecs) and the high frequency (pulsed) EM fields will persist for about one usec (as is typical in EM pulsed generators) and will provide electric field strengths in the range of 500 to 5,000 volts/cm/atmosphere.

Low and moderate frequency high electric fields are provided by the protruding plug tip which is excited just prior to spark firing as the voltage builds up, and where intentional "non-sparking" is produced by allowing the primary voltage to decay in a controlled way so that the output voltage drops as low as 5000 to 10,000 volts and is not able to produce a spark, and instead produces a long duration oscillating field strength of order 5000–10,000 volts/cm.

The EM Ignition system thus operates preferably in a multi pulse mode with an initial ringing pulse followed by a sequence of single pulses of several pulses per millisecond and a duty cycle in the range of 30% to 60% (for an assumed spark oscillation frequency of 10–20 KiloHertz). The EM Ignition power supply preferably uses control features which allow it to generate both high "boost power" for rapid spark firing and high efficiency. Also preferably provided is a reduction in of number of pulses with engine speed compensating in part for the increased number of ignition firings with engine speed, and a small increase of their frequency with engine speed.

When a suitable high "boost power" power supply and rapid firing ignition controller is used with a very high efficiency low turns ratio coil, with a high efficiency discharge capacitor and switches (a CDC system), and with a large capacitance EM spark plug with a protruding antenna tip sparking to the shell and piston, and with suitable shielding material and tuning high voltage chokes to control the capacitive spark components, one obtains an ignition system with unprecedented efficiency and igniting ability and which is retrofitable to existing automobile engines. Its igniting ability is superior to plasma jet, and it will allow an automobile engine to operate in the range of 22:1 to 24:1 air-fuel (AF) ratio through its ability to produce very large and centrally located ignition source with all three key ignition components present. In this way, automobiles equipped with the EM Ignition system and carburetter rejetted to use an air-fuel ratio mixture of at least 22:1 under cruising conditions, will be able to meet contemplated European emission standards and provide a fifteen to thirty percent efficiency improvement over current three-way catalyst engines.

BRIEF DESCRIPTION OF THE DRAWINGS

The nature and objects of the invention are illustrated and described with reference to the following drawings, which also illustrate the preferred embodiments of the invention.

DESCRIPTION OF PREFERRED EMBODIMENTS

Figure 1:
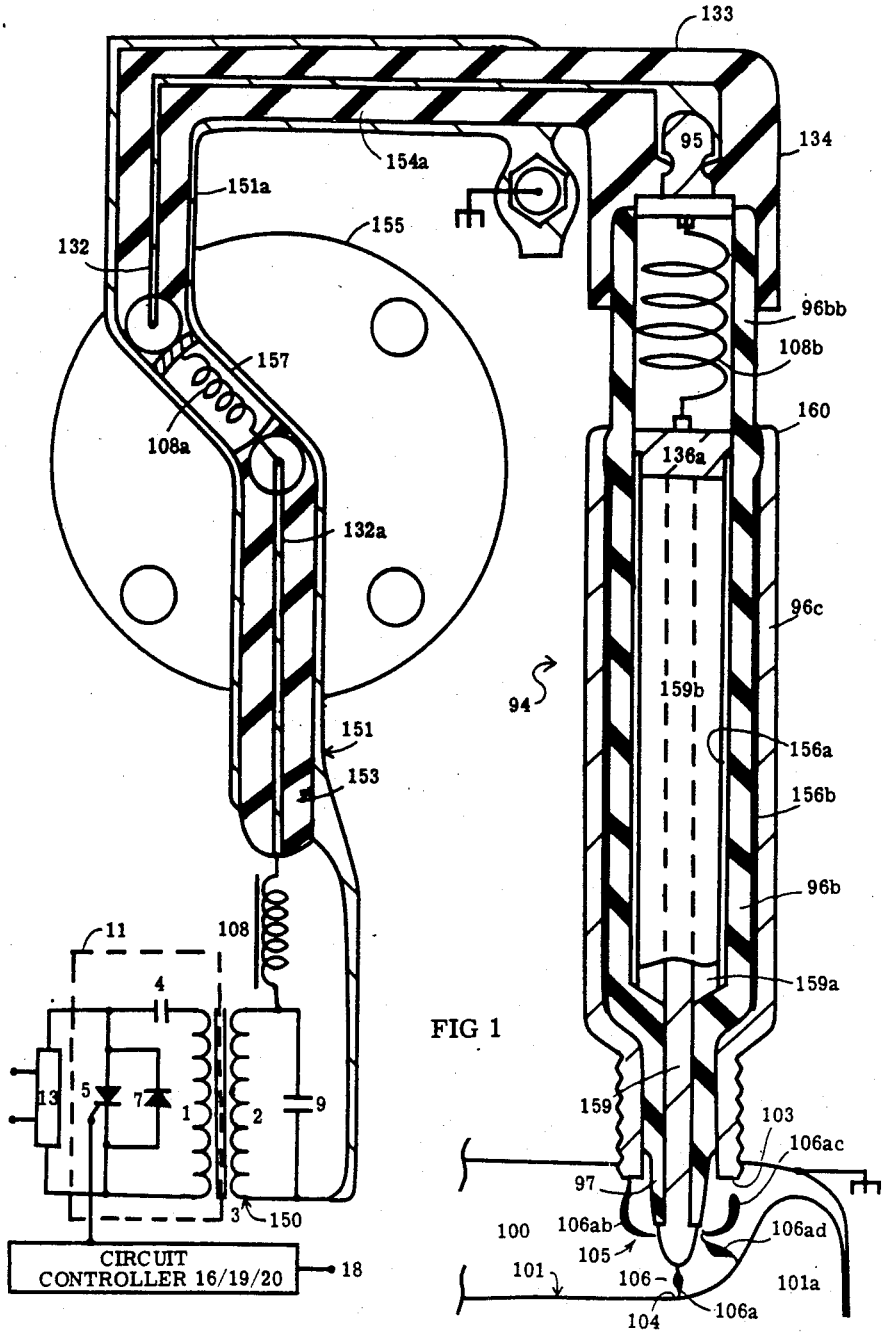
FIG. 1 depicts a preferred embodiment of the complete EM Ignition system including a CD circuit and a secondary circuit for a four cylinder engine with EM controlling and EMI supressing circuitry and cables, and a preferred capacive EM spark plug with plated ceramic surfaces, internal choke, and a protruding antenna tip projecting into the combustion chamber of a hemi-head type combustion chamber, with the plug tip further designed to break down at a voltage between 15 and 30 Kilovolts under all operating conditions of the engine.

FIG. 1 is a preferred embodiment of the EM Ignition system applied to a four cylinder engine. It includes a DC to DC power converter 13 and discharge circuit 11 for driving the system, and a preferred high voltage circuit including tuning inductors 108, 108*a*, 108*b* and shielded cables 151/151*a* designed to minimize EMI while delivering maximum capacitive energy to the spark, and an improved EM (RF) spark plug 94 with a projecting antenna tip 105. In operation, the system provides a range of high amplitude/high frequency spark currents and high electric fields in the vicinity of the spark/flame initiation to enhance combustion reactions.

The discharge circuit includes coil 3 (primary 1, secondary 2), capacitor 4, SCR 5, and diode 7. The Circuit Controller used for controlling the ignition waveform is made up of blocks 16/19/20, where block 19 is the input trigger shaper (receiving its trigger at 18), 20 is the gate width controller defining the ignition firing duration, and 16 is preferably a dual controller, a power supply controller (of a current pump type supply 13 which uses a gated oscillator), and also the timing signal controller for SCR 5.

Figure 2A:
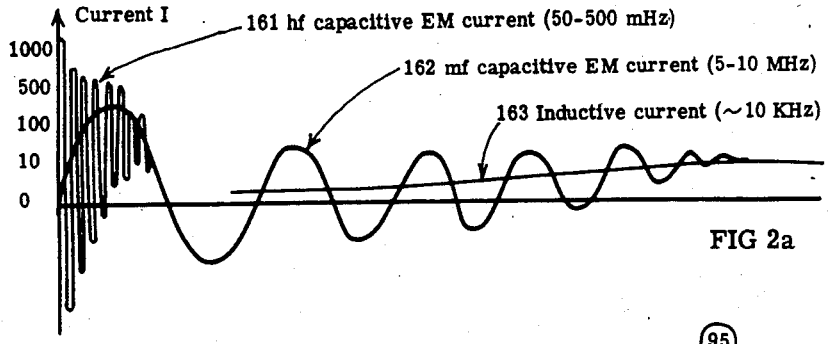
FIG. 2*a* depicts the three principal current waveforms that exist following breakdown of the spark gap of FIG. 1 and the discharge of the plug capacitance, coil output capacitance, and primary circuit discharge capacitance.
Figure 2:
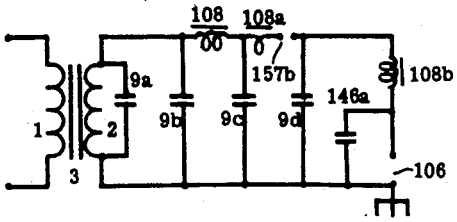
FIG. 2 is an equivalent circuit of the secondary high voltage side of the ignition circuit of FIG. 1 including various capacitances and control choke inductors.

Inspecting the high voltage circuit of FIG. 1 with reference to FIG. 2, which is an equivalent circuit of it, we note the inclusion of the three inductors 108, 108*a*, 108*b*. They serve in general to tune and control the high voltage capacitive part of the ignition discharge to maximize energy delivered to the spark and minimize EMI. Specifically, they operate in series to tune the discharge of capacitor 9 to a lower desirable frequency of approximately 10 MHz. Output capacitor 9 is in general made up output capacitance 9*a* (Csc) of coil 3, and any additional capacitor 9*b* (Csa) which may be purposely placed across the output of secondary coil winding 2.

With reference to "approximately" 10 MHz, we henceforth define approximately X to equal a value between X minus 40% and X plus 40%; i.e. approximately 10 MHz means a value between 6 MHz and 14 MHz. Note that a value of 10 MHz is well above AM radio and well below FM radio.

Tuning of the discharge of output capacitance 9 follows from the formula:

$$fs=1/[(2*pi)*SQRT(Ls*Cs),$$

where pi=3.142

Ls=total secondary inductance (108+108*a*+108*b*)

$Cs=Csc+Csa$.

For Cs equal to 100 pf, then Ls=2.5 uHenry for fs=10 MHz, which can be divided for example into 1.5 uHenry for 108, 0.25 uHenry for 108*a*, and 0.75 uHenry for 108*b*. For a higher value of capacitance Cs, say 250 pf, Ls=1 uHenry for fs=10 MHz, and the source impedance $Zs=SQRT(Ls/Cs)=60$ ohms, which gives a a peak current of 400 amps for a breakdown voltage of 25 Kvolts.

Inductor 108*a* also works to lower the frequency of the discharge formed at the rotor tip of rotor 157 of distributor 155 when capacitance 9*c*, FIG. 2 (capacitance of cable 153 with respect shield 151) discharges. Likewise inductor 108*b* operates on its respective spark plug cable of capacitance 9*d*, FIG. 2, (cable 154*a* with shield 151*a*) to lower its frequency.

Shielding 151 is included on the king lead 153 which is connected to the return wire 150 of the coil secondary winding to limit the size of the radiating loop. In this preferred embodiment low side of primary winding 1 is isolated from low side 150 of secondary winding 2. Shield 151 can be terminated at either of three places: (1) at the engine block near the distributor 155; (2) at the engine block after it is continued (as is shown in this drawing) on shields on the respective spark plugs (151*a* shown); (3) on each respective spark plug casing, producing the tightest shielding. Preferably ferrite material is included around the spark plug wire, such as Capcon EMI Suppressant tubing which absorbs above 10 MHz, and only significantly above 20 MHz (3 DB insertion loss for a one foot length at 20 MHz). This will allow the tuned capacitive energy (at say 5 to 10 MHz) to pass and be available to the spark while absorbing the very high frequency components (except those generated by the spark plug capacitance 146*a*, FIG. 2). One can also instead place the suppressant tubing outside the shield to minimize attenuation of the capacitive current available to the spark (while maximizing attenuation of EMI passing through the shield). Use of high frequency Litz wire for center conductors 132, 132*a* also will minimize attenuation.

Spark plug 94 of FIG. 1 features four preferred embodiments: (1) thin, highly conductive (copper or silver) layers of foil or plating 156*a*, 156*b* sandwiched around insulator 96*b* (and anchored with conductive material 159*a* to conductor 159) to provide maximum capacitance through intimate contact with the ceramic surfaces of insulator 96*b*, and providing maximum electrical conductivity by use of silver or copper (of only 0.001" thickness on the outside layer 156*b* because of the very high frequency discharge of plug capacitance 146*a*); (2) high purity (99.5%) Alumina for insulator 96*b* to provide a 30% higher breakdown voltage so that only 0.10" wall thickness material is needed for 36 Kvolts operation, and to provide a higher dielectric constant of 10 (versus 9); (3) built-in inductor 108*b* to both minimize radiation from discharge of capacitances 9*a*, 9*b*, 9*c*, 9*d* (FIG. 2) and to trap energy of plug capacitance 146*a* so that it dischages into sparks 106*a*, 106*ab*, 106*ac*, 106*ad*, and into the combustion chamber 100; (4) an antenna spark plug tip design 105 shown in greater detail in FIGS. 3*a*, 4, protruding into combustion chamber 100 capable of producing a large volume of high local electric fields and multiple local site sparking for crank angle ignition timing greater than 20 degrees (most engine operating conditions), such multiple local site sparks forming sparks 106*ab* to the edge of the spark plug shell 103, spark 106*ac* to the side wall if a side wall exists, spark 106*ad* to the side of piston 101*a* if a piston side rise exists, and spark 106*a* to the opposing surface 104 of piston 101*a*.

In this spark plug design inductor 108*b* is contained within casing 96*bb*, the top part of the spark plug insulator 96*b*, and connects between the top plug electrode 95 and at the bottom to 136*a*, a metallic cap fitting on top of the surface 156*a* connected to the center electrode conductor 159 by means of conductive layer 156*a* or optional conductor 159*b*. Typical inductance of inductor 108*b* with an air core is 0.5 uHenry (for 0.4 inch diameter, 1 inch length, and 12 turns per inch). Metallic cap 136*a* also functions to reduce the electric field intensity at the top end of surface 156*a*, and outer shell 96*c* provides a natural rounding of the end of surface 156*b* by means of end 160.

FIG. 2 is simply an equivalent circuit of the high voltage output side of FIG. 1 as already discussed, where the various components have already been described with reference to the description of FIG. 1 and is further described with reference to FIG. 2*a* below.

FIG. 2*a* depicts an actual preferred spark current characteristic based on the design of FIG. 1 (with reference to equivalent circuit FIG. 2). The capacitive EM current 161 (designated "EM current" because of its high frequency of 50–500 MHz) results from the discharge of plug capacitance 146*a* (FIG. 2) and is characterized by a very high peaked ringing current in the range of 400 to 2000 amps, delivering energy to the spark plasma at a rate of the order of 100 Kilowatts. This current is followed by the herein designated Capacitive current 162 which results from discharge of capacitances 9*a* and 9*b* (FIG. 2), which are tuned by inductors 108+108*a*+108*b* to preferably the range of 5 to 10 MHz and will have a peak current typically in between 100 and 400 amps and will deliver power to the spark plasma at a rate of the order of 10 Kilowatts (unless this component is purposely minimized in lieu of the EM or other current components or to reduce EMI). For low resistance and well sized spark plug wire (e.g. Litz wire), this component can persist for several useconds.

Finally, there is the inductive component with its 10 kHz frequency and 2–5 amp peak current, resulting from discharge of capacitor 4 through the ignition coil 3. In the present case the coil preferably has a large core of greater than one square inch cross sectional area so that fewer primary turns can be used to reduce the overall copper losses, e.g. 10 to 20 turns of No. 8 to 14 wire for the primary winding and 50 turns ratio of say No. 24 wire for the secondary winding (assuming a 5 to 10 ufarad input capacitor 4 operating at 330 to 360 volts (400 volt capacitor)). With a suitable large spark gap of say 0.2 inches the arc (spark) burning voltage can easily be in the range of 200 to 400 volts to deliver power to the spark plasma at the rate of the order of 10 Kilowatts.

Figures 6, 6A:
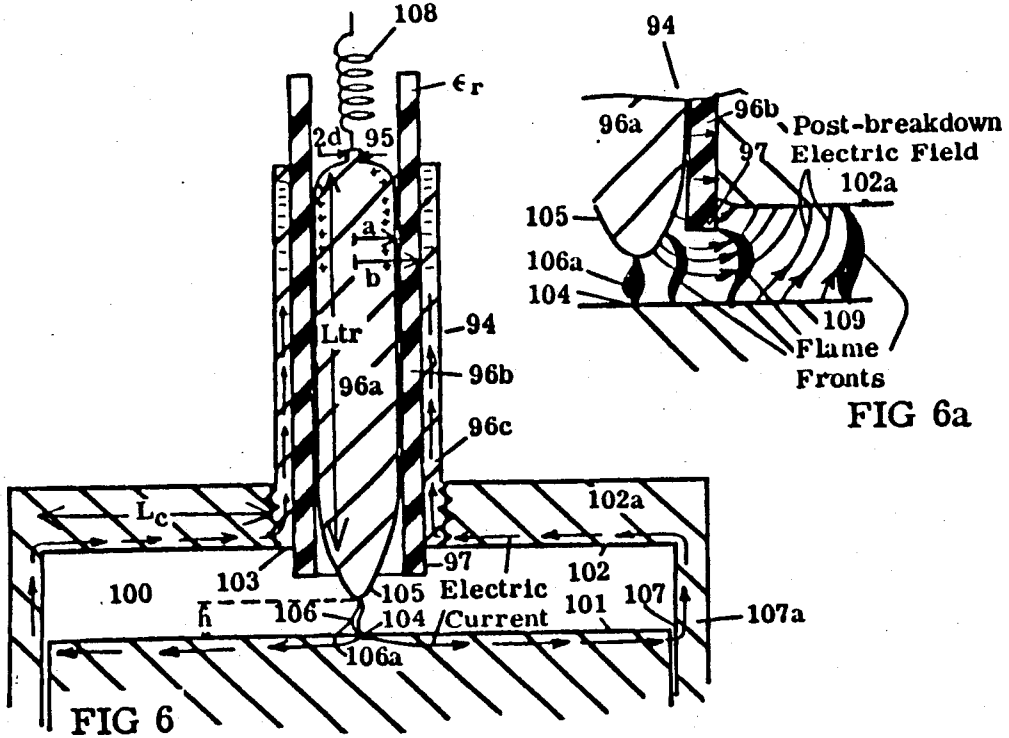
FIG. 6 is a schematic of the capacitive RF spark plug connected to an engine cylinder showing the EM current and charge distributions and various RF and plug parameters.
FIG. 6*a* is a drawing of the plug-cylinder junction of FIG. 6 showing the local electric fields and propagating initial flame.

Two types of such EM current exist, the "Short Circuit" EM type ("EMSC"), and the "Open Circuit" EM type ("EMOC"). The EMSC current is characterized by a small electric field transverse to the spark at the spark site (less than 500 volts/cm/atmosphere). The spark represents an electrical "short circuit" (e.g. sparks 106*ab* and 106*ac* of FIG. 1) and has no significant transverse electric field component to further stimulate the ignition plasma and ensuing flame kernel. The EMOC current on the other hand is characterized by a very large transverse electric field at the spark plug site, as disclosed with reference to FIG. 6, which can be as high as 10,000 volts/cm/atmosphere. This occurs as a result of electrical phase shift (or equivalent series inductance) from the short circuit point (e.g. piston forming sparks 106*a*, 106*ad* of FIG. 1) in combination with the return current, which form a transmission line with high field transverse to the spark current direction. This field will further heat the plasma or not depending on whether this field is exposed to ignition plasma or not. In FIG. 6*a* it is exposed to both the plasma and initial flame.

With reference to FIGS. 2, 2*a* it is noted that one can have more that three current components. For example, one could build significant capacitance (say 100 pf) into each individual spark plug wire as represented by the (coaxial) cable 132/154*a*/151*a* shown, and using an inductor such as 108*b* tune the discharge to a frequency between that represented by 161 and 162, e.g. 40 MHz versus 200 MHz for 161 and 8 MHz for 162; the in-between component also delivers power at an in-between rate of say 40 Kilowatts.

Figure 3:
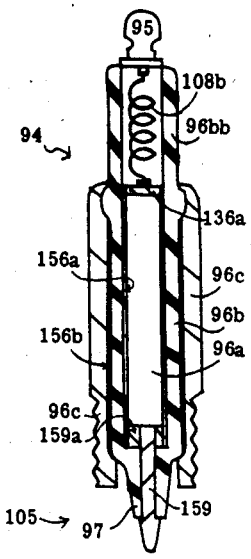
FIG. 3 is a simplified spark plug which incorporates the key features identified with reference to FIG. 1.

FIG. 3 depicts a simplified alternative design to plug 94 of FIG. 1 drawn approximately to scale. This design is specially suitable for plugs with an 18 mm thread 96*c* since this plug design features a constant large diameter center "conductor" 96*a* (e.g. 0.48 inch diameter) for a high capacitance and low resistance. In this case center "conductor" 96*a* is replaced by conductive layer 156*a*, top cap 136*a*, and bottom cap 159*a* which connects to tip center conductor 159 contained inside insulator tip 97. Insulating shell 96*b* is also a simple straight through tubular design except for the tip 105, which is described more fully in FIGS. 3*a*, and 4. Inductor 108*b* is easily built into the top part 96bb of insulator 96b between electrode 95 and cap 136a.

Figure 3A:
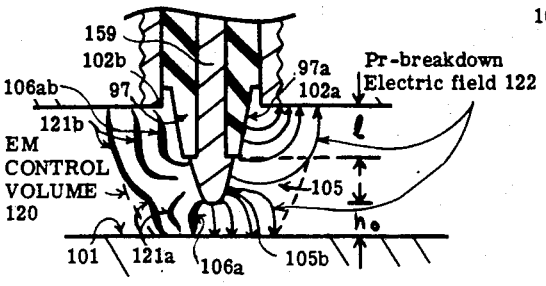
FIG. 3*a* is a detailed spark plug tip design for producing both back-firing and piston-firing during one multiple pulse plug firing for most operating conditions (timing advance of greater than 20 degrees BTDC) and depicting the "EM Control Volume".

FIG. 3a is a preferred embodiment of tips of spark plug 94 of FIGS. 1 and 3, comprising a projecting antenna tip 105 constructed to provide multiple site firing to the cylinder head 102a or plug shell 102b ("reverse" firing to form spark 106ab) and/or to the piston surface 101 ("forward" firing to form spark 106a). Insulator projecting length "l" is optimally 0.2 inches to provide such multiple site firing during one ignition and to behave as a good antenna. The value of 0.2 inches is arrived at as follows: Typical breakdown voltage for the plug tips shown is approximately 40 volts/mil for a normal forward gap at one atmosphere. Reverse breakdown for the tip designs shown is approximately ⅔ of this value or 26 volts per mil. For l=0.2 inches this corresponds to a reverse breakdown voltage of 5,200 volts. However, l=0.2 corresponds to a forward gap of 0.14 (on the basis of breakdown voltage) which for a typical small engine (Ford Escort) corresponds to a crank angle of approximately 20 degrees for an initial gap ho of 0.05 inches, which in turn corresponds to a compression pressure ratio of 7.5 (assuming a 9 to 1 compression ratio engine). At this crank angle of 20 degrees it is equally likely that the spark will fire forward or backwards (reverse breakdown). At non-cranking full load conditions (assuming 90% volumetric efficiency) the applied pressure is about 6.7 atmospheres (i.e. approximately 7.5*0.9) so the breakdown voltage at this crank position is 33 Kvolts and it is the maximum breakdown voltage (the value drops as the timing is further advanced). It is therefore seen that l=0.2 inches insures that the spark will always fire, and that for the typical lean burn engine part load timing of 25 to 40 degrees, and a multi pulsing ignition with a typical ignition duration of say 24 crank angle degrees, both reverse 106ab and forward 106a firing will occur, thus forming a very large ignition volume. Also, the breakdown voltage under normal operating conditions will be in the range of 15 to 30 Kilovolts to provide the required high capacitive components of the spark and the high "non-firing" electric fields.

The plug tip 105 is preferably constructed of convex shape (shape 97a for the insulator 97 and shape 105b for the electrode tip 105 and made as thin as is practical (see FIG. 4) to spread the "Pre-breakdown Electric field 122" to as large as "EM Control Volume 120" as possible (of approximately ½ inch radius shown here). This volume is defined as that including field strengths in excess of 1000 volts/cm/atmosphere, where the high field is produced by the high voltage between the center electrode 159 and "ground" as shown, the drop across the plug insulating material being very small (1/9 that of air since the dielectric constant of the alumina insulator is typically 9).

Figure 4:
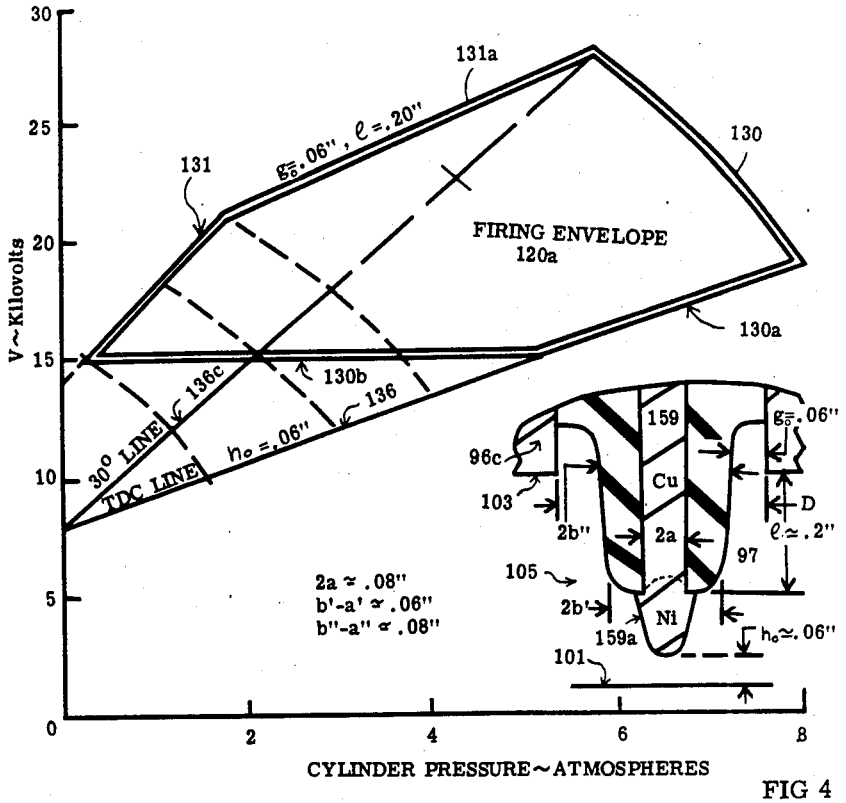
FIG. 4 depicts a preferred "Firing Envelope" for the preferred protruding antenna plug tip designs of FIGS. 1, 3, 3*a* with reference to a preferred plug tip and its parameters.

In FIG. 4 is defined in more detail the plug tip parameters to provide a "Firing Envelope" 120a within the voltage range of 15 to 30 Kilovolts, and to provide an optimum antenna and large spark generating structure that will withstand all conditions of operation of an IC engine.

With reference to the plug tip 105, insulator tip 97, center conductor 159 (preferably made of Copper with a Nickel alloy tip 159a), piston and plug shell surfaces 101, 103, we define the plug parameters in terms of (typical) values and ranges:

| PLUG PARAMETER | VALUE | RANGE |
|---|---|---|
| Center conductor diameter 2a | 0.08" | 1/16"-⅛" |
| Insulator end thickness b'-a' | 0.06" | 0.05"-0.08" |
| Insulator base thickness b"-a" | 0.08" | 0.06"-0.10" |
| Inculator projecting length 1 | 0.2" | 0.16"-0.24" |
| TDC plug tip piston gap ho | 0.06" | 0.04"-0.08" |
| Plug base gap go | 0.06" | 0.04"-0.08" |

With the above values and assuming a four cylinder 1985 Ford CVH engine as the base engine, we generate the "Firing Envelope" 120a defined by curves 131, 131a, 130, 130a, 130b. Radial lines 136, 136a are piston firing voltage curves for TDC and 30 degrees BTDC as a function of cylinder pressure above atmospheric, and curve 131/131c is the plug shell firing voltage curve. From the above values we see that the preferred insulator 97 base diameter 2b" is ¼" and the plug thread 96c ID "D" is 0.36".

For an engine such as the Ford engine, the engine timing is such that piston firing is not available at low pressures, so the "Firing Envelope" is closed by curve 130b which places a minimum breakdown voltage of 15 Kilovolts in this case (and a maximum of 28 Kilovolts). This is a desired result both in terms of producing high capacitive currents (FIG. 2a), high "Pre-breakdown electric fields" (FIGS. 3a, 5a–5c), and high frequency, high EM fields (FIGS. 6, 6a), the long antenna type structure of tip 159 further insuring that a as large as possible "EM Control Volume" (FIG. 3a) or volume of electrical influence is produced.

Figure 5A:
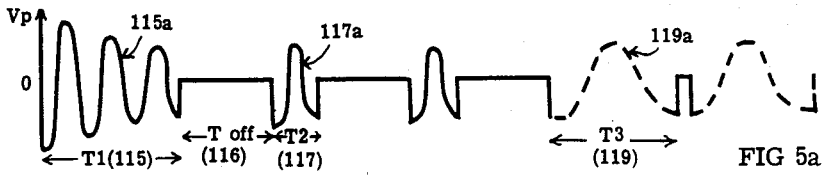
FIGS. 5*a* and 5*b* shows two preferred primary voltage ignition pulsing waveforms designed to enhance the low frequency high electric field at the plug tip.
Figure 5B:
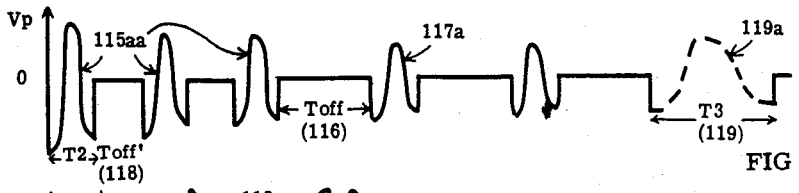
Figure 5C:
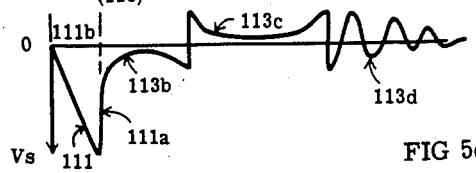
FIG. 5*c* shows the secondary voltage waveform for one single sinewave firing.

In FIGS. 6 to 10b are depicted means for generating high EM (electric) fields associated with spark formation to the piston top. In FIGS. 5a to 5c are described multiple spark ignition profiles suitable to, in addition, producing large electric fields at the plug tip 105 through use of an antenna tip structure combined with high breakdown voltages as described in FIG. 4, for the purpose of electrically stimulating the initial flame fronts (121b, FIG. 3a) contained within the EM Control Volume (FIG. 3a).

FIG. 5a depicts preferred (cosine) primary voltage waveforms made up of a "ringing" voltage 115a of duration T1 (115) followed by sequential OFF-TIMES 116 (TOFF) and single voltage curves 117a of period T2 (117), followed by non-firing voltage curves 119a of period T3, where TOFF is chosen such that T3 is just smaller than T2+TOFF. Voltage curves 119a represent switching of the primary circuit (11 of FIG. 1) with insufficient secondary voltage Vs to fire the plug, which results in a secondary voltage of similar shape and duration (T3) as 119a, but of typical amplitude of 5,000 to 10,000 volts peak with high frequency oscillations (of ten times the frequency, or approximately 30 KHz) superimposed, to produce very high local electric fields strengths to influence the initial flame.

In FIG. 5b the initial "ringing" waveform 115a is replaced with closely spaced single waveforms 115aa (separated by a minimum practical OFF-TIME TOFF' (118) (corresponding to the waveform period T2 of approximately 80 usecs in this example). The advantage here is the addition of the pre-breakdown high voltage periods defined by 111, 111a of FIG. 5c, and the oscillating high voltage 113d, which naturally exists to further enhance the burn. The arc burning voltages 113b, 113c are high (200–400 volts) due to the large spark gaps to deliver maximum power to the spark.

With reference to FIGS. 5a, 5b the spacing between the pulses and the overall duration of the ignition pulse train are influenced by the mixture combustion properties in conjunction with the EM control volume (FIG. 3a) generated by the antenna plug tip.

The flame speed in engines of typical hydrocarbon fuels, e.g. propane, gasoline, etc, is of order of 50 cms/sec, and the actual propagation of the initial flame is of order 200 cm/sec (due to the expansion effect). This translates to 0.2 cm/msec or ¼ inch per 3 msec, where a ¼ inch radius corresponds to the radius of intense electric field with reference to FIGS. 3a, 4, 5a, 5b, 5c, i.e. the EM Control Volume. There is one additional complication, and that relates to the scale of turbulence in the air-fuel mixture. At low engine speeds it is usually larger than ¼ inch, and at high speeds it is less than ¼ inch.

The objective of the EM (high electric field) influence on the initial flame is to help the flame along until at least it is well entrained by the microscale turbulence. At low speeds, this means that the pulsing train duration (FIGS. 5a, 5b) should be made to last for a time of the order of 3 msecs, which is reduced to say 1 msec at 3000 RPM and in which the spacing between pulses is also preferably reduced to some extent.

With reference to the entire disclosure so far for producing the desirable ignition characteristics discussed herein, there are some features common to other systems, but by far the most critical ones depart appreciably from conventional techniques and variants of such for producing ignition in IC engines. The differences are too numerous to list with reference to the prior art, but in order to give an indication of the differences, a sample of them are briefly described in the following paragraphs.

Conventional systems use resistive plugs, resistive cables, resistive rotors, high resistance coil secondaries (all of order 1000 ohms) to operate properly. In EM Ignition, resistance is intolerable, and must be reduced by hundreds to thousands of times. Furthermore, it is not sufficient to simply eliminate the resistances, but great care must be taken to construct the components so they have unusually low resistance, e.g. as in the coil, which was only made possible with the invention disclosed in U.S. patent application Ser. No. 688,030, now U.S. Pat. No. 4,677,960, and as in the spark plug cables, whose center conductors must be preferably made of high frequency Litz wire, and so on.

Conventional designs use resistive and other techniques to minimize the various high frequency discharges occurring upon spark firing. In the present systems, the parts are designed to maximize the various spark discharges and to deliver them to the plug tip with minimum dissipation. In addition, multiple pulsing per ignition firing is preferred, which for conventional systems is a serious source of EMI interference and of other problems.

Conventional systems use spark plugs with either grounding electrodes or with short and stubby surface gap type construction. Experimental plugs with long tips exist for special applications. If one modifies the longest tipped experimental plugs or experimental long length surface gap type plugs, one finds the plugs will not survive as their tip insulation thickness is typically 0.030" to 0.050", which puncture at high loads and high RPMs.

In long surface gap type plugs, the thrust of the design is opposite of the present ones, in that there the dimensions are chosen to produce the lowest breakdown voltage and the flattest slope of breakdown voltage versus applied pressure. Here the approach is to produce under all conditions the highest practical breakdown voltage with a positive slope and to innovatively use "forward" and "backward" firing to achieve this objective.

In designs where shielding must be used, e.g. air craft plugs and spark plug cables, care is taken to minimize the capacitance that the shield provides to the high voltage electrodes. Herein, capacitance is preferably controllably built in to provide high frequency capacitive/EM currents upon discharge of those capacitances.

In conventional design, "fast high voltage rise times" are preferable, versus the present designs which use high output capacitance to (also) increase the rise time duration so that high voltage is available for a longer duration in conjunction with the antenna tipped plug to electrically stimulate combustion.

In conventional CD systems input capacitances of about 1 ufarad are preferred, whereas in the present system an input capacitance one order of magnitude greater (ten times greater) is preferred, i.e. 10 ufarads, to be used in conjunction with a "voltage doubling coil", high output capacitance, and multiple pulsing for improved ignition and electric field stimulation.

In conventional designs one takes great care to eliminate "misfiring". In the present design, one preferably includes "misfirings", or rather "non-firing" pulses as part of a spark firing ignition pulse train beginning with an actual spark for the purpose of stimulating the initial combustion.

Current spark plug technology is moving towards slimmer bodied and smaller thread diameter spark plugs. The current design is preferably a fat plug with the largest practical thread diameter (the older 18 mm threads still used in some vehicles).

Unusual older experimental ignitions which used piston firing worked to minimize the breakdown voltage to the piston. In this design the objective is to maximize the breakdown voltage (to preferably be greater than 15 Kilovolts under all conditions of firing to the piston).

Most "high energy ignitions" are designed to limit the spark current to less than 400 ma to limit spark plug erosion, and also because as it is argued (e.g. Bosch Technical reports) that there is hardly any additional benefit for currents greater than that. In the present design the "voltage doubling coil" invention is used to produce a peak current ten times that maximum, or 4 amps.

Current spark plug designs concentrate on heat sinking the plug tip by recessing it so that it does not cause preignition. In this case the plug tip is also an antenna and is designed to protrude as far into the combustion chamber as possible, relying in part on its ability to operate with very lean mixtures so that preignition is minimized.

It can be appreciated after thorough study, that the present invention (EM Ignition) represent an orchestration of many, many unusual concepts a partial list of which has been enumerated here, (many of which are by convention "wrong") to produce in a highly synergistic way an ignition system with an unprecedented efficiency and igniting ability.

FIG. 6 is a schematic of the capacitive RF plug 94 (briefly described in FIG. 1) connected to the cylinder head 102*a* of a conventional engine cylinder. In this drawing are indicated the optimal requirements for the plug, that it have a large inner conductor 96*a* radius "a" and a thin dielectric layer (b−a) of preferably large dielectric constant εr to provide a large capacitance 98 given by:

$$Cp=0.24*\epsilon r*Ltr/(\log b/a) \text{ picofarads for Ltr in cms,}$$

where Ltr is the plug length as indicated in the figure.

If high purity Alumina is used for the insulating dielectric 96*b* (relative dielectric constant εr of 9) and the following plug dimensions are chosen:

a=0.275";

b=0.375";

(b−a)=0.10"

Ltr=2.25"

then the plug capacitance Cp is given by:

Cp=100 picofarads (pf)

which is in the range specified (50–250 pf).

In this application, by firing the spark from the plug tip 105 to the point 104 of piston surface 101 of piston 101*a*, the energy stored in the plug capacitance in transfered to EM field energy and current since the current is forced to flow along the piston face 101 and up and along the cylinder wall face 107 and cylinder head face 102 as indicated in the figure to form an EM self-resonant chamber. If, as is further shown, the plug inner radius "a" is constricted at the top end or interface 95 to a radius "d" (where "d" is much less than "a") and an inductor 108 is connected to end 95, then a large EM impedance mismatch exists at that interface 95. The current is then reflected at interface 95 so that the combination of plug 94 (of length Ltr) and combustion chamber 100 (of radius Lc) become a EM self-resonant quarter wave transmission line cavity able to EM excite the ignition/flame plasma near the plug tip, i.e. instead of having a zero electric field component at region or plug gap 106 as would occur if the spark was fired and grounded directly to the cylinder head 103, the zero field point (also maximum current point) is shifted to the cylinder surface 107 making region 106 a moderate field point.

In particular, the field E1 at the plug gap 106, upon breakdown of the gap, is given approximately by:

$$E1=E01*(Lc/(SQRT(\epsilon r)*Ltr+Lc)$$

where we assume Lc is less than SQRT(εr)*Ltr, and where E01 is approximately given by:

$$E01=E0/SQRT(1+Vol.1/\epsilon r*Vol.0)$$

where Vol.1 and Vol.0 are respectively the chamber 100 volume and the dielectric layer 96*b* volumes, and E0 is the electric field in the dielectric layer 96*b* just prior electrical breakdown of 106. This field is given approximately by:

$$E0=Vsb/(b-a)*SQRT(\epsilon r))$$

It can be shown from the above that it possible to obtain field strengths at gap 106 immediately after breakdown of 10,000 volts per cm when the piston is near top dead center (TDC), for the values given above and further assuming a voltage of approximately 20,000 volts prior to breakdown. Optimally, one requires Ltr to be as small as practical while Cp is of the order of 100 pf or greater (to provide significant capacitive energy). This is achieved with a relatively short and large diameter plug with a high plug capacitance (high εr). The large plug conductor 96*a* diameter "2*a*" also reduces the current losses as the plug capacitive energy is discharged in the form of resonantly oscillating current confined to a thin surface layer about 0.001" thick since the frequency of oscillation is in the hundreds of Mega-Hertz.

FIG. 6*a* shows a detail of the electric field lines and the propagating initial flame fronts 109 in the vicinity of the spark 106*a*. It is easy to see that EM stimulation can be provided by this electric field distribution. However, since this high frequency, high electric field strength oscillation persists for only about one microsecond, one must repeatedly and rapidly fire gap 106 to provide significant EM energy, as was disclosed with reference to discharge circuit of FIG. 4*a*. Since gap 106 must also recover (deionize) to insure moderately high breakdown voltage, the presence of turbulence at gap 106 will assist in increasing the rate of firing (as well as having the positive effect of spreading the plasma discharge). The effect of the EM field can be further enhanced by the use of two spark plugs as disclosed in U.S. Pat. No. 4,499,872, as long as the plugs are located nearer to the center of the cylinder than the wall. In particular, the EM field (and even current) of one plug can be made to interact with the discharge and flame plasma of the other plug, and vice versa, although this will depend in part on how well the current spreads over the entire piston surface, which is a function of the Q (quality factor) of the chamber 100, and a function of the way in which the breakdown current couples to the rest of the chamber 100.

To more fully appreciate the electrical breakdown characteristics of a piston spark gap, some general formulas are developed. The breakdown voltage Vb itself for any crank angle is proportional, to first order, to the gap length h, which is a function of crank angle as given below (for small crank angles about TDC for a flat piston and a flat cylinder head):

$$h=h0+0.5*LS*(1-\cos(\theta))$$

$$h0=\text{gap length at TDC;}$$

where

LS=length of the piston stroke;

θ=crank angle degrees about TDC.

The breakdown field is also proportional to the air density D, which, as a function of crank angle about TDC, is related to the density D0 at BDC by:

$$D=D0/[(1/(CR-1))+0.5*(1-\cos(\theta))]$$

where

Figure 8:
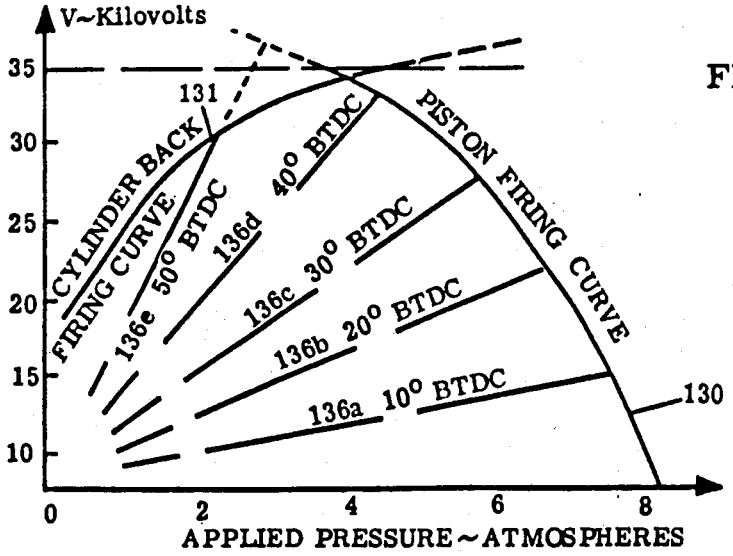
FIG. 8 depicts the "Breakdown Voltage Envelope" for the RF plug defined by breakdown voltage, pressure, and ignition timing.

CR=the engine compression ratio. Since in general the spark timing is advanced under part load conditions (D0 low), and mechanical advance is generally small, the breakdown voltage, which is proportional to (h*D), does not change appreciably as the timing is advanced in a typical automobile spark ignited IC engine. Even for constant (maximum) D0 as is shown in FIG. 8 (e.g. corresponding to a spark ignited diesel), it only increases by a factor of approximately three over 40 degrees advance, as governed by the above formulas.

The above relationships can be modified by contouring the piston around the spark plug tip so that Vb changes by a lesser amount with crank angle position about TDC, as discussed below. This is equivalent to multiplying $(1-\cos(\theta))$ by $G(\theta)$ which is a weighting factor which decreases with crank angle position about TDC.

Figure 7A:
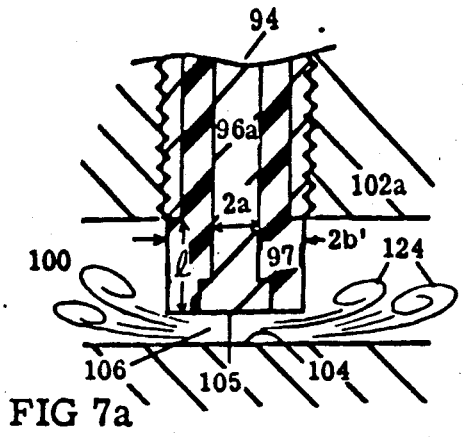
FIG. 7*a* is a drawing of a large tipped RF plug used to generate squish with the piston face and spread the ignition plasma.

FIG. 7*a* shows a fragmentary view of a plug tip design which assists in the spreading of the initial plasma kernel indicated as 124 by producing a squish effect with the piston face 104 as the piston approaches the plug end 105. Preferably the plug end diameter is as large as practical (18 mm or greater thread) such that the insulating end 97 has a large diameter "2*b*'". Typical dimensions for the plug tip are given with reference to FIG. 8.

Figure 7B:
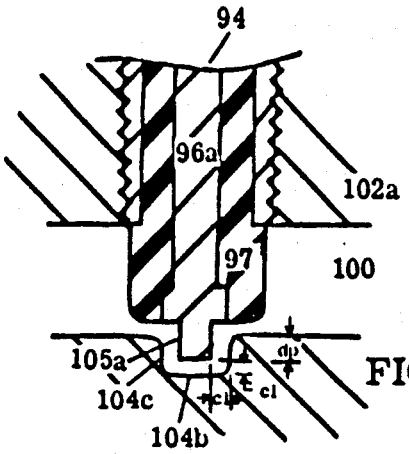
FIG. 7*b* is a drawing of a plug tip used in combination with a symmetric piston face indentation to permit greater advancement of the timing.

FIG. 7*b* is a fragmentary view showing a plug/piston top design which allows for greater advancement of timing without misfire by reducing the increase in Vb with crank angle near TDC. The plug tip 105 has a metallic extension **105*a* beyond the ceramic end 97, and the piston has indentation 104*b*/104*c* directly across from the tip 105*b* to accomodate the tip with side clearance "cl" equal to say 0.050", and depth penetration "dp" equal to say 0.10", so as to produce a smaller effective gap for a given level of advancement of the timing. The depth of the piston indentation is approximately equal to dp plus the side clearance. In terms of $G(\theta)$, one can view $G(\theta)$ to be inversely proportional to $(1-\cos(\theta))$ until the end of 105*a* is well out of the indentation 104*b*/104*c*. The tip 105*a*** in this case is preferably made of an erosion resistant material such as tungsten-nickel-iron, or other material.

Figure 7C:
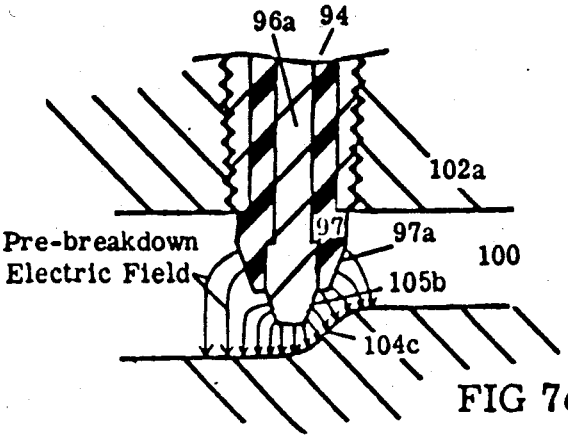
FIG. 7*c* depicts a plug tip used in combination with an asymmetric piston face indentation for more timing advance, and a substantially pointed plug tip to focus the electric field onto the piston face.

FIG. 7*c* depicts a plug/piston top design for reducing the rate of increase in Vb with crank angle. This design is based on a piston with a squish type contour, as is common in diesel engines and some gasoline engines. The plug tip **97*a*/105*b* is located near the squish edge region 104*c*, such that as the piston moves down from TDC the spark gap increases proportionally less. In this embodiment ceramic tip 97*a* and electrode tip 105*b*** have a pointed shape as shown which tends to focus the electric field to the piston as shown and reduce the breakdown voltage Vb.

Below is a table of effective gap h', density D, and maximum Vb for a 1.3 liter Ford engine (LS=2.5", CR=9.5, h0=0.0250"):

| | h | h' | D | D0 max | Vb max |
|---|---|---|---|---|---|
| 0 | .025" | .025" | 9*D0 | .9 | 20 KV |
| 10 | .045" | .045" | 8*D0 | .9 | 30 KV |
| 20 | .10" | .090" | 7*D0 | .6 | 36 KV |
| 30 | .17" | .14" | 6*D0 | .4 | 34 KV |
| 40 | .30" | .24" | 5*D0 | .3 | 36 KV |

The actual breakdown field Vbmax will be lower than the values indicated above due to other factors including the focussing of the electric field as indicated in the figure. In essence, what this example shows is that for any particular engine one can design the plug tip/-piston contour around the tip (and modify the timing advance/vacuum characteristics by a small amount if necessary) to provide a variable spark size from say 0.05" at full load (but more typically greater than 0.080") to 0.25" at part load while the breakdown voltage is kept in the range of 16 to 32 KV under all operating conditions.

FIG. 8 depicts the breakdown voltage Vb of the RF plug 94 as a function of engine timing in degrees before TDC (BTDC) and as a function of load or more simply Applied Pressure. The right hand "Piston Firing" curve 130 represents the envelope of maximum breakdown voltages Vb (of gap 106) as a function of applied pressure for various spark timings. The curve was generated assuming a compression ratio of nine (CR=9), a piston stroke of 3", and a maximum volumetric efficiency of 90%. The drop in maximum Vb with the advancing of the timing is due to the reduction in air density or air compression with earlier timing as dictated by the formula presented earlier.

It is this drop in Vb which is being taken advantage of or compensated for in the present design. For a standard spark gap under lean part load conditions where the timing is substantially advanced to compensate for the slower burn, Vb is small leading to no capacitive spark and no EM spark, and to a relatively small inductive spark (relative to the chamber volume 100), making it difficult to ignite such an air-fuel mixture and provide peak pressure at the correct time. On the other hand, with the present system the lower pressures under these conditions are compensated for by firing across the large gap 106 to the piston face 104, producing a high Vb and hence a large capacitive and EM component, and also a large inductive spark component (because of the large gap 106). These spark components in turn lead to a faster burn, allowing for a less advanced timing, which is beneficial towards maintaining high engine efficiency, and low hydrocarbon emissions under very lean conditions (because the burn is occuring near TDC, where the temperatures are higher).

The left hand "Cylinder Back Firing" curve 131 is independent of timing and depends on pressure as shown. The actual shape depends on the geometry of the insulated plug tip 105/97. For the designs presented here, "1" is greater than 0.20", and the dielectric thickness (b'−a) is greater than 0.050". The tip 105/97 is chosen so that the "Cylinder Back Firing Curve" 131 intersects curve 130 at a voltage level below the full output voltage capability of the ignition system (e.g. 35 Kilovolts). Below are typical dimensions for plug tip 105/97 (for 14 mm and 18 mm plugs):

| 14 mm plug | 18 mm plug |
|---|---|
| 1 = .25" | 1 = .20" |
| 2b' = .40" | 2b' = .60" |
| 2a = .20" | 2a = .40" |

In this way we insure that the plug will not misfire under any conditions, especially under high load, high RPM conditions where the timing may be substantially advanced to compensate in part for the leaner mixture's slower burn time.

FIG. **9*a* depicts a coaxial, capacitance, RF plug 94 suitable for the CEMI system shown about 1.4 times full scale based on a standard 14 mm spark plug, with tip dimensions approximately equal to those given above (for the 14 mm case), and with dimensions "a" and "b" and insulating material as specified with reference to FIG. 6, which lead to a plug capacitance Cp approximately equal to 100 pf for Ltr=2.25 inches. The plug top 95*b* has a diameter of approximately ¾ inches and therefore requires a special large diameter boot, although the plug hex of outer shell 96c can be the standard 13/16 inch hex. The center conductor 96a can be made up of one piece which is bonded to the ceramic insulator 96b, or of two pieces which are sleeved as shown, and held in place at the two ends 95a and 105. Ends 97 and 105** can be tapered, or contoured to any practical shape.

Figure 9A:
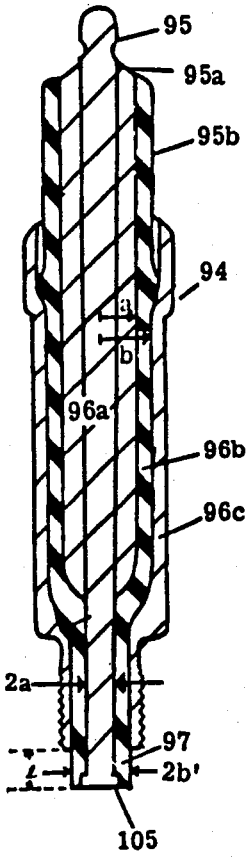
FIG. 9*a* is a detailed drawing of an RF plug design based on a standard 14 mm plug design.
Figure 9B:
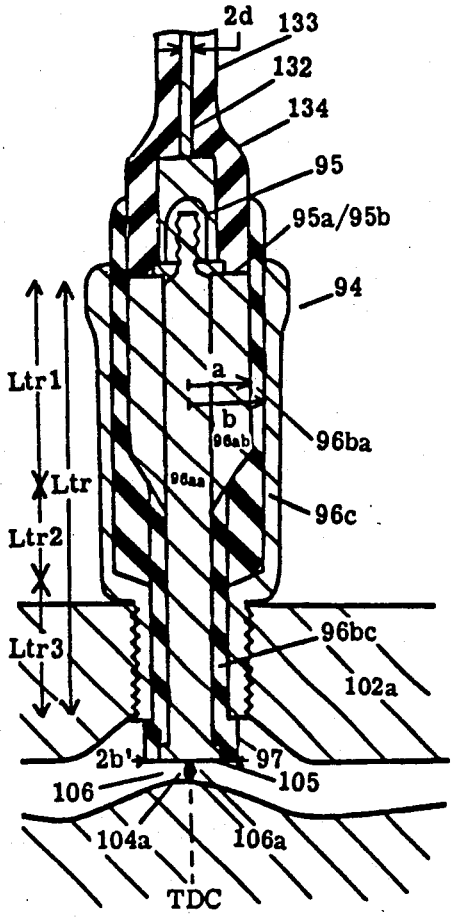
FIG. 9*b* is a large diameter RF plug design incorporating a two piece ceramic insulator shown mounted on the "cylinder head" of a rotary type engine.

FIG. 9b is an RF plug which is designed based on the optimization criteria of large diameter 2a, short length Ltr, and large tip diameter 2b'. The thread is also the preferred 18 mm, with corresponding plug tip dimensions as given above. The drawing is approximately full scale. Also shown is a two piece ceramic construction, with 96ba (length Ltr1) made up of high dielectric constant, low RF loss material, such as Emerson and Cuming HiK material. Dielectric layer 96ba provides most of the capacitance Cp. Ceramic 96bc is made up of the lowest practical dielectric constant ceramic and shortest length Ltr3 (to minimize EM phase shift in this region which contributes minimally to Cp). Ltr2 is also made short for the same reasons. Conductors 96aa and 96ab have a high surface (0.001 inch) electrical conductivity to minimize RF current losses (preferably silver plating). Plug end 95a/95b has a large change in diameter to provide a large mismatch of at least twenty to one, i.e. $2a=1''$, $2d/=0.05''$, where 2d is the wire 132 diameter of the spark plug wire 133 with a boot 134 which fits inside the plug as shown. Preferably an inductor 108 (shown in FIG. 6) is also connected to plug end 95 to further increase the degree of EM mismatch and limit RF noise.

The plus is shown mounted on the "cylinder head" 102a of a rotary type engine where the surface at the center 104a of the rotor is protruding to give a larger gap 106 as the timing is advanced. The surface 104a is designed to produce a breakdown voltage Vb within the range from 16 KV to 32 KV, as discussed earlier, for the entire range of engine operation where timing and applied pressure are varied.

Figure 10A:
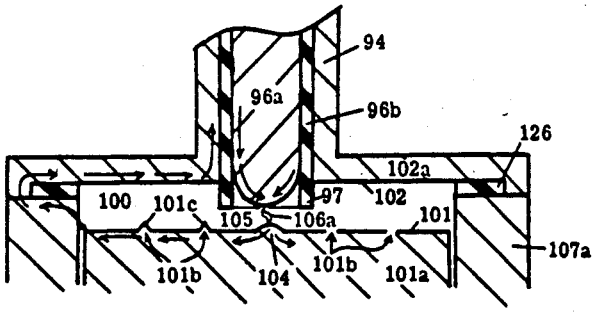
FIG. 10*a* is a side view of an RF plug mounted on a cylinder head of a piston IC engine with an interrupted electrical conductive piston surface for producing several series sparks and a ceramic annulus or insert to increase the electrical volume of the combustion chamber.

FIG. 10a is a fragmentary side view schematic of an RF plug 94 mounted on a cylinder head 102a of an IC engine with piston 101a having a metallic surface 101 which is broken or interrupted by insulating gaps 101b across which sparks 101c are formed when spark 106a is formed to the piston (region 104) across tip 105 of high voltage conductor 96a of plug 94. In this way, because the current is forced across the piston surface 101, several ignition sites 101c are formed across the combustion chamber 100 to provide more rapid combustion of the mixture. Also shown is a ceramic annulus or ring 126 which effectively increases the electrical chamber volume as disclosed elsewhere, and which serves in this case to reduce the current at the piston/cylinder gap 101a/107a and to increase the relative field strength at the spark gap region 106 and at the other ignition sites along the piston. Preferably, the annulus is of high dielectric constant material such as high purity Alumina. Alternatively, the annulus can be constructed to insert vertically into the cylinder sleeve 107a and thus minimize the overall diameter of the engine cylinder.

Figure 10B:
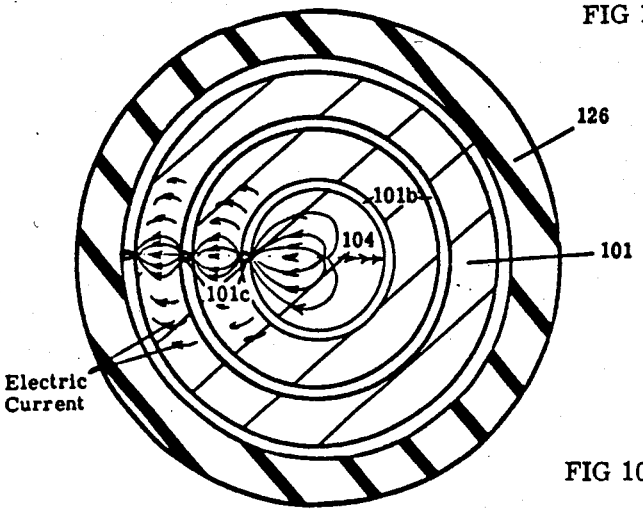
FIG. 10*b* is a top view of FIG. 10*a*.

FIG. 10b shows a cross sectional top view of the piston with a preferred method of forming gaps 101b, and a resulting possible current distribution obtained by firing the spark 106a to the piston 106a. Such a striated surface can be produced by spraying a ceramic coating on a conventional piston top and then spraying thick metallic layered coatings of thickness say 0.025" on top of it (not shown). The cylinder head can also be treated in the same way. Since the capacitance of the gaps differ substantially from each other, most of the high breakdown voltage will be sequentially impressed across the gaps in the order of smallest capacitance, and hence not require substantially higher voltage to produce the many ignition sites. That is, the voltage will be impressed across each gap (in inverse capacitance order) and sequentially break each gap down until all the gaps are ionized and a complete path to ground is formed. One can also contour the striations to insure that the sparks 101c occur at desired locations, such as at the fuel sites of say spark ignited direct fuel injection engines. For two plugs one can provide contours such that each plug has a path independent of the other. In addition, the sparking surfaces of the various spark gaps, including the top piston ring for a piston engine or the rotor seal of a rotary engine, are preferably coated with erosion resistant material such as nickel-iron and combinations with tungsten or molybdenum.

Figure 11A:
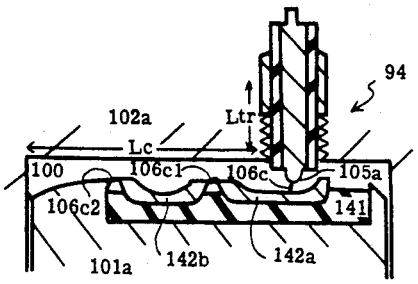
FIGS. 11*a*, 11*b* are side and top views respectively of an IC engine combustion chamber depicting a preferred embodiment of an interrupted electrically conductive piston for producing multiple series ignition sparks using a long ceramic tube to provide the electrical isolation from the piston and the series gaps for formation of the multiple series sparks.
Figure 11B:
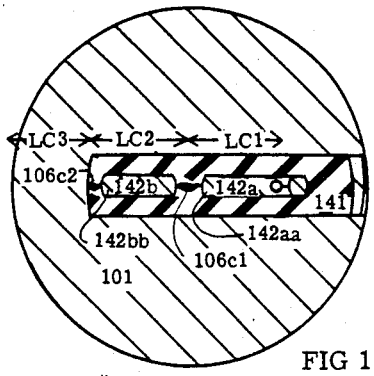

FIGS. 11a and 11b are side and top views respectively of an EM plug 94 mounted on a cylinder head 102a of an IC engine with piston 101a with a metallic surface 101 in which is imbedded an insulating ceramic tube 141 containing two wire metallic "islands" 142a, 142b which complete the electrical path between themselves and tip 105a of plug 94 by means of sparks 106a, 106c1, and 106c2. Preferably gaps forming sparks 106c1, 106c2 are approximately 1/16 inch, and wire 142a is contoured around plug tip 105a as defined with reference to FIGS. 7b, 7c, to permit breakdown of gap between 105a and 142a under all normal operating conditions. Islands 142a, 142b are sufficiently well insulated from piston surface 101 to prevent breakdown to it. Preferably, a high dielectric constant material of thickness approximately ⅛ inch is used for 141, providing capacitance to ground (165a, (Cg1), 166a (Cg2), FIG. 11c) of wires 142a and 142b respectively in the range of two to ten picofarads, which is much greater than the air gap capacitances C01, C12, C23 between the three arc forming tips 105a, 142aa, and 142bb (gaps 146c, 165c, and 166c of FIG. 11c respectively).

Figure 11C:
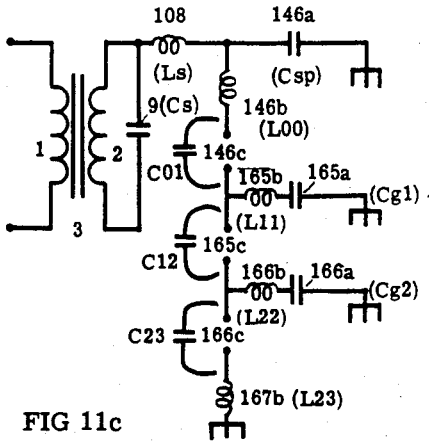
FIG. 11*c* is an equivalent circuit of the secondary high voltage side of the ignition circuit of FIG. 1 combined with piston series gaps of FIGS. 11*a*/11*b*, 12 used to describe the phenomenon of enhanced secondary voltages available for breaking down gaps in series with the main spark plug gap.

With reference to FIG. 11c, Csp is the plug capacitance 146a, 146b (L00) is the inductance of conductor length Ltr (FIG. 1), and 165b (L11), 166b (L22), 167b (L23) are the equivalent inductances of conductive lengths Lc1, Lc2, Lc3 respectively (FIG. 11b). For the purposes of the present discussion, the high voltage source elements are shown, namely the output capacitance 9 (made up of 9a and 9b, FIG. 2) of total capacitance Cs connected to the coil secondary 2 of coil 3.

It can be shown that discharge of capacitors 9 through choke 108 (of inductance Ls) to form spark 106a across gap 164c produces up to just short of double the voltage on conductor 142a due to resonance charging with an oscillation frequency determined by Ls and the combined capacitances of Csp and Cg1 (where inductor L00 is ignored as it is negligible). This enhanced voltage is useful in breaking down gaps 165c, 166c, although there is a trade-off in terms of how long the higher voltage is sustained (because of the "formative time constant").

There exists a "formative time constant" Tf which represents the time a voltage must be sustained to produce breakdown of a gap. The lower the available voltage for breakdown, the greater the (formative) time needed, or conversely, a higher voltage has a lower formative time Tf associated with it. For the present application Tf is in the range of 20 nanosecs (nsecs) to 2 usecs, which is in the range of times corresponding to the oscillation period of Ls and Cg1 (and Cg2).

There is therefore a distinct advantage in using higher load capacitances (which goes contrary to normal thinking) if one can design the system so that the voltage doubling phenomenon can be used to advantage. Furthermore, even in ordinary initial breakdown there is an advantage to using the high output capacitances proposed herein since they increase the voltage rise time and therefore the time duration at for which a given high voltage is sustained.

Figure 11D:
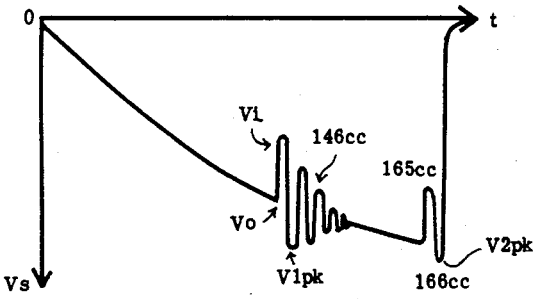
FIG. 11*d* is a voltage-time curve of the secondary coil high voltage appearing at the various series gaps of FIGS. 11*a* and 11*b*, as the gaps break down.

In the analysis of series gap breakdown described above there is an additional complication because of the presence of the plug capacitance Csp. When gap 146c breaks down, the plug capacitance Csp "immediately" discharges to bring the voltage to a value Vi (FIG. **11*d*) (in about 1 nsec, which is "immediate" on the time scale of 100 nsecs). Without the plug capacitance, the voltage would drop to zero and oscillate near twice its initial value (since Cg1 is much less than Cs) at a frequency determined by Ls and Cg1 only (and not by Cg1+Csp). With significant plug capacitance Cso (with values between Cs and Cg1), the voltage oscillates with oscillations 146*cc* (FIG. 11*d***), overshooting the initial value Vo as shown to a peak Vpk1, with a frequency determined by Ls and Csp+Cg1. We have a trade-off between oscillation frequency (time at a given voltage and peak voltage).

It should be noted with reference to "series gaps" that these relate only to those in the combustion chamber. It is a feature of this invention that no series gaps are included in the high voltage secondary circuits, as is sometimes done by others to "hold off" the secondary voltage. The high minimum breakdown secondary voltages achieved here (see FIG. 4) are done by proper plug tip design. Necessary gaps, such as the rotor tip gap, are not series gaps since they are necessary for the high voltage distribution and are kept to a minimum size, e.g. 0.020".

Below are given a set of preferable values of the various equivalent circuit parameters of FIG. **11*c***.

Cs=160 picofarads (pf)

Csp=40 pf

Cgi=10 pf, (where Cgi represents either Cg1 or Cg2)

Ls=10 uHenry

Inductor Ls gives a frequency of 5 MHz for discharge of Cs, which fulfills other criteria, and a frequency of 10 MHz for oscillations determined by Ls and Csp in parallel with Cgi. Ultimately, one must experimentally pick the various parameters within constraints of practicality to obtain the best trade-off of maximum peak voltage and maximum duration (relative to the formative time Tf). The important point to appreciate is that large Cg1 is not detrimental because of resonance charging and long chraging time.

FIG. **11*d* is an example of the voltage rise on the high voltage secondary circuit indicating a case in which the voltage breaks down the main spark gap 146*c* (FIG. 11*c***) but the peak voltage V1*pk* is not sufficient to initially produce breakdown of the series gaps, but V2*pk* is not sufficviently high to produce breakdown. Vs is the secondary voltage and and t is time from initiation of the high secondary voltage.

Figure 12:
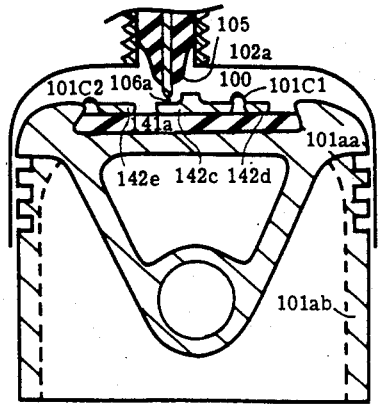
FIG. 12 is a preferred embodiment of a piston constructed to provide multiple series ignition sparks which is constructed to include a low thermal expansion coefficient upper land on which is applied the insulating coating and conductive islands.

FIG. 12 is a preferred embodiment of a piston **101*aa* on which is mounted or plasma sprayed an insulating layer 141*a* (approximately ⅛ inch thick) and in which are imbedded or sprayed metallic islands 142*c*, 142*d*, 142*e*. The piston is shown as a two piece piston with a top part 101*aa* made of low thermal expansion coefficient material such as iron or titanium and a bottom/side part 101*ab* preferably made of aluminum (for cost and/or weight reasons). Shown also is a fragmentary tip section 105 of a spark plug, forming sparks 106*a*, 101*c*1, 101*c*2, as in FIGS. 11*a*, 11*b*. In operation this design is similar to that of FIGS. 11*a*, 11*b* although islands 142*c*, 142*d*, 142*e* are shaped and located to produce ignition sparks in the sequence of 106*a*, followed by 101*c*1, followed by 101*c*2**.

Since certain changes may be made in the above apparatus and method without departing from the scope of the invention herein involved, it is intended that all matter contained in the above description, or shown in the accompanying drawings, shall be interpreted in an illustrative an not in a limiting sense.

What is claimed is:

1. An electrical ignition system comprising a high voltage ignition coil capable of producing a voltage Vs greater than 20 Kilovolts for igniting air-fuel mixtures contained in a combustion chamber of an internal combustion engine, the chamber being defined by at least an outer fixed chamber member and an inner chamber member, at least one spark plug mounted on said outer chamber member to produce an ignition spark inside said combustion chamber, a secondary winding of said coil in combination with said plug and interconnecting cable comprising secondary circuit capacitance Cs to ground, and means defining a spark plug firing end including a high voltage igniting tip constructed and arranged to electrically break down the air-fuel mixture gap between said igniting tip and said inner or outer combustion chamber member under conditions enabling an effective breakdown over a length of at least 0.1 inch (0.25 cm) to produce a spark of at least 0.1 inch (0.25 cm) under at least one condition of operation of said engine, so as to provide under all normal operating conditions of said engine a high breakdown voltage and corresponding high secondary capacitive stored energy just prior to breakdown given by ½*Cs*Vs**2 which is greater than five millijoules for delivery of said energy immediately after breakdown of said gap.

2. The system defined in claim 1 wherein said outer chamber member is a cylinder head and said inner member is the top face of a piston of a reciprocating internal combustion engine.

3. The system defined in claim 1 wherein said inner chamber member is the rotor of a rotary type internal combustion engine.

4. The system defined in claim 1 wherein said inner chamber member is a movable compression means used for compressing air-fuel mixture prior to ignition and wherein said system comprises means providing a total output capacitance of at least 50 picofarads connected to output of said high voltage coil and wherein said high voltage coil is a low turns ratio high efficiency coil with a turns ratio between 40 and 60 which is part of a capacitive discharge (CD) circuit with a discharge capacitor of capacitance greater than 3 microfarads which is charged to a voltage of approximately 350 volts and wherein said high voltage coil provides at least 30 kilovolts output voltage and a spark current with a first current peak of at least 1 amp.

5. The system defined in claim 4 wherein said coil is a very high efficiency coil with a primary winding being made up of No. 8 to No. 14 wire and a coil turns ratio between 20 and 30 and wherein said discharge capacitor has a capacitance of at least two microfarads which is charged to a voltage of approximately 700 volts.

6. The system defined in claim 4 or 5 wherein said CD circuit comprises a bistable semiconductor switch including reverse recovery diode for controlling spark firing, and said discharge capacitor is connected to said bistable semiconductor switch so as to be fired during ignition to be able to produce a long duration discharge by keeping said bistable semiconductor switch ON for several oscillations of said discharge circuit.

7. The system defined in claim 1 wherein said inner chamber member comprises a cyclically movable member, and wherein said ignition coil secondary capacitance is of at least 50 picofarads, and said spark plug capacitance is of at least 20 picofarads, and the plug firing end is constructed and arranged to produce an ignition spark gap of at least about 0.1" (0.25 cm) under all operating conditions of said internal combustion engine except when the cyclically movable member is within 15 degrees of TDC when the gap may be smaller.

8. The system defined in claim 7 wherein said high voltage ignition coil has connected in series with its secondary winding high voltage output an inductive choke of inductance between 5 and 400 microhenry to limit very high frequency current produced by the discharge of said coil secondary capacitance during spark formation, which is responsible for radio frequency interference (RFI).

9. The system defined in claim 7 or 8 wherein said plug firing end and said movable member are dimensioned and designed so as to form a spark between said firing end and said movable member such that under all normal operating conditions of the engine the breakdown voltage forming said spark is within the range of 10 to 33 KV, wherein said ignition coil has a turns ratio between 40 and 60 and is part of a CD circuit including a discharge capacitor of capacitance greater than 3 microfarads charged to a voltage of approximately 350 volts, and wherein the system further includes multiple pulsing circuit for producing closely spaced multiple spark pulses.

10. The system defined in claim 7 or 8 wherein a discharge circuit including the ignition coil and discharge capacitors, bistable switching means and a recovery diode is contained in a grounded metallic enclosure, and wherein the coil secondary wire comprising the central conductor of high voltage coaxial cable with grounded outer conductor is connected to shielded intermediary components connected to coaxial shielded plugs such that RFI is supressed.

11. The system defined in claim 7 wherein central high voltage conductor of said sprak plug has at least one diameter not less than 0.4 inches (1.0 cm) and a spark plug tip of the plug firing end constructed to fire either back upon the circular edge of the plug shell surrounding said plug tip or across to said movable member, and wherein said minimum 0.4 inch (1.0 cm) diameter conductor is surrounded by high purity alumina dielectric insulating material of thickness about 0.1 inch (0.25 cm) and of relative dielectric constant of approximately nine.

12. The system defined in claim 11 wherein said dielectric material is low RF loss material with dielectric constant greater than 10.

13. The system defined in claim 11 wherein said spark plug tip comprises a protruding central electrical conductor of length at least 0.2 inches (0.5 cm) surrounded by an insulating material of at least one thickness greater than 0.060 inches (0.15 cm), said spark plug being disposed to ignite said mixture by making a spark either to said movable member in said chamber or to said fixed member of said chamber by firing backwards, wherein said fixed and movable member and tip are dimensioned and disposed such that the spark gap breakdown voltage varies within the range of 10 to 30 Kilovolts under normal operating conditions of said internal combustion engine.

14. The system defined in claim 13 wherein site at which tip of said spark plug is located is the edge of an air-squish zone.

15. The system defined in claim 1 wherein said high voltage igniting tip is constructed and arranged to electrically break down the air-fuel mixture gap between said igniting tip and said outer and/or said inner combustion chamber member with voltage in excess of 10 Kilovolts to supply said minimum 5 millijoules capacitive spark energy under all normal operating conditions of said IC engine without use of a series gap, and enabling an effective breakdown over a length of at least 0.16 inch (0.4 cm) to produce a spark of at least 0.16 inch (0.4 cm) under at least one condition of operation of said IC engine.

16. The system defined in claim 15 wherein said high voltage coil is constructed with primary and secondary windings to produce a voltage greater than 30 Kilovolts into a capacitive load greater than 100 pf and an initial capacitive spark peak breakdown current in excess of 100 amps.

17. The system defined in claim 16 wherein said combustion chamber outer fixed member is a cylinder head and said inner member is the top face of an air-fuel mixture compressing means of an IC engine, wherein compressing means moves to and from a top dead center, TDC, position of closest proximity to the outer member whereby minimizing chamber volume as defined, and wherein the sum of spark plug capacitance Csp and capacitance Cs' at the coil secondary side including externally added capacitors is greater than 100 pf and wherein said current peak in excess of 100 amps is produced by discharge of plug capacitance Csp.

18. System in accordance with claim 17 wherein said spark plug firing end central conductor tip is within and insulated from a spark plug shell with insulation length extending beyond plug shell end of length between 0.16" and 0.32" (0.4 cm and 0.8 cm) and defining a gap between said spark plug tip and said inner compressing means of at least 0.04 inches (0.1 cm) at TDC, and wherein spark formation of said plug tip defines an electrical breakdown "Firing Envelope" with a minimum voltage of 10 Kilovolts and a maximum voltage of 30 Kilovolts.

19. The system defined in claim 18 wherein said plug firing end defines an antenna tip with base diameter $2b''$ approximately equal to $\frac{1}{4}''$ ($\frac{5}{8}$ cm) and base gap "go" equal to 0.04" (0.1 cm).

20. System in accordance with claim 18 constructed and arranged so that immediately upon breakdown at the spark plug tip, the capacitance Csp discharges electrical charge producing EM current oscillations of frequency between 50 and 500 MHz and with peak currents in excess of 200 amps, and the capacitance Cs' discharges producing capacitive current oscillations of frequency between 2 and 20 MHz with peak currents in excess of 20 amps, and wherein a choke inductor Ls with inductance value between 1 and 400 microhenries is interposed between high voltage terminal of secondary winding of said coil and said high voltage tip of spark plug to tune frequency of said capacitive current corresponding to discharge of capacitor Cs' to below 10 MHz.

21. The system defined in claim 20 wherein said high voltage coil is a low turns ratio high efficiency coil with a turns ratio in between 45 and 55 which is part of a capacitive discharge (CD) circuit with a 400 volt rated discharge capacitor of capacitance value of 4 to 20 microfarads providing an inductive spark current with a current peak greater than 2 amps.

22. The system defined in claim 4 or 21 wherein said coil is a high efficiency coil with primary and secondary turns wound on the arms of a closed magnetic core of cross sectional area approximately one square inch, said primary winding made up of No. 8 to No. 14 wire and secondary winding made up of No. 22 to 26 wire.

23. The system defined in claim 21 including a spark plug lead connecting coil high voltage to plug and wherein low voltage wire of coil secondary winding is isolated from low voltage primary winding and said low secondary wire defines a shield for said spark plug lead, which shield is grounded to the IC engine block.

24. The system defined in claim 23 including ferrite material which begins to absorb EMI above 10 MHz which is placed around said spark plug central wire.

25. The system defined in claim 24 including distributor means to distribute high voltage to several spark plugs wherein all the spark plugs are shielded with metallic shielding material grounded at or near each respective spark plug shell and other ends of said shields are all connected together to an end of shield surrounding King lead which finds its ground through each spark plug shield and is connected to the isolated low side of coil secondary.

26. The system defined in claim 25 wherein spark plug contain in their body a choke inductor of inductance 0.25 to 5 microhenries.

27. The system of claim 25 wherein in addition to said two choke inductors there is a choke inductor mounted on rotor arm of distributor used for distributing high voltage to the spark plugs.

28. The system defined in claim 26 wherein said spark plug includes plug capacitance in excess of 20 pf made up of electrically conducting plating placed on outer and inner surfaces of the plug insulator and wherein said inductor is interposed between said inner plating and plug means used for connecting plug to high voltage means.

29. The system defined in claim 18 wherein said plug is part of a CDC ignition system producing multiple ignition pulses per ignition pulse firing train and wherein said antenna plug tip defines an EM Control Volume characterized by the sequential production of ignition spark pulses and high electric fields.

30. The system defined in claim 29 wherein duration of said firing train varies from approximately 3 msecs at 1000 RPM down to 1 msec at 3000 RPM, and wherein time between pulses at 1000 RPM is greater than time between pulses at 3000 RPM.

31. Combustion ignition system comprising in combination:

(a) means defining a spark plug for mounting in a combustion chamber and for acting as a first anchor of a sparking discharge extending therefrom to a spaced portion of a combustion chamber wall, which effectively provides a ground return to an ignition circuit through said chamber wall, (b) means defining said ignition circuit, said circuit being connected to said spark plug for effecting at least one space firing period having an initial VHF to UHF current oscillation lasting for at least about one microsecond, whereby an electrical self resonance is induced in the combustion chamber by the circulation of said VHF-UHF current along the chamber wall to establish an oscillating EM field which enhances said spark discharge and flame kernel, while each such spark firing period further includes high capacitive and inductive spark energy transfer from the circuit to the spark.

32. The ignition system of claim 31 in combination with an internal combustion engine comprising a movable wall which moves relative to to a fixed wall to cyclically change the combustion volume, the spark plug being mounted in said fixed wall for sparking to the movable wall in an orientation which enables said self resonant chamber effect, and wherein said ignition circuit is further constructed and arranged for effecting multiple of pulses with OFF periods between them establishing repetitions of the initial VHF-UHF oscillations with EM energy components followed by inductive lower frequency sparks.

33. The ignition system of claim 32 wherein the spark plug has a capacitance in the range of 20 to 200 picofarads whereby a lean air-fuel mixture is excess of 20 to 1 can be fired under normal cruise engine operating conditions.

34. Ignition system in accordance with claim 33 including an external EM energy source connected to said combustion chamber for resonantly exciting said chamber during formation of said sparking discharge.

35. Ignition system in accordance with claim 33 wherein said movable wall is the rotor of a rotary engine with a central TDC contoured surface constructed and arranged such that as spark timing is advanced the spark gap between said movable wall and spark plug increases, for at least 50 degrees BTDC, and wherein the product of spark gap length and intake manifold pressure is within a range of four for timing of up to 50 degrees BTDC and provides a spark breakdown voltage which is within the range of 10 to 30 kilovolts.

36. Internal combustion engine apparatus comprising:

(a) a combustion chamber formed of a cylinder;

(b) a piston disposed in said cylinder for compressing air-fuel mixture by moving in successive cycles to and from a TDC position defining a minimum combustion volume; the improvement comprising a combustion ignition system comprising at least one high voltage high capacitance electrode mounted in a central zone of the top of said cylinder and constructed and arranged as part of a CD ignition circuit to effect oscillations of sparking to the face of said piston during a spark firing period to generate essentially entirely internally to said combustion chamber and said high capacitance electrode circuit a VHF to UHF self resonant electrical oscillation and wherein the capacitance of high capacitance electrode is at least 20 picofarads and said spark firing period includes inductive component of at least two oscillations during a single engine cycle.

37. The system defined in claim 36 wherein said piston face at site of said electrode is contoured to provide a smaller change in said main spark gap relative to change in piston position about TDC.

38. The system defined in claim 36 wherein said high voltage capacitance electrode comprises a center conductor of a spark plug having a capacitance contained in the body of said spark plug between said center conductor and an outer shell and said system including an ignition coil and an inductor interposed between said center conductor and said ignition coil to confine said self resonance to within said plug and said chamber.

39. The system defined in claim 38 wherein the value of inductance of said inductor in units of microhenries is within a factor of five of the value of the output capacitance of said ignition coil in units of picofarads.

40. In a combustion apparatus comprising an enclosed combustion volume, a spark ignition and fuel and air feeding means, and an improved ignition system comprising means for generating an initial capacitive high frequency spark discharge of high initial breakdown voltage within the range of 3 MHz to 600 MHz oscillating internally within said combustion volume at an initial field strength in excess of 500 volts/cm/atmosphere for a duration of at least of the order of magnitude of one microsecond, through ignition circuit controlled conversion from a power supply of essentially DC frequency, i.e. frequency less than 1 MHz, the ignition system being constructed and arranged to repetitively render such spark discharges in repetitive combustion cycles.

41. The apparatus of claim 40 wherein said ignition system includes means for generating at least one follow on spark discharge within said volume, the initial and follow on discharges comprising a total ignition cycle corresponding to a single combustion cycle, the system further being constructed and arranged with low RF loss and to prevent misfire (failure to discharge) as the volume and discharge length increases within the preselected TDC range for said discharge, and wherein said apparatus includes means for changing said volume, the latter means comprising a cylinder with a fixed cylinder head, a movably reciprocatable piston face for approaching and receding from said fixed cylinder head, a spark plug firing end located essentially centrally in said head and insulated and impedance mismatched to force said discharges to be made to said piston face, with a ground return path comprising the piston, the wall of said cylinder, and said cylinder head.

42. The apparatus of claim 41 including a ceramic annulus communicating with said combustion volume so that said high frequency discharge currents flow around said annulus and effectively lower the oscillation frequency of said discharge currents.

43. The apparatus of claim 42 wherein said cylinder includes a sleeve and a gasket-type member sandwiched between said cylinder head and sleeve, said annulus being contained in said gasket-type member.

44. The apparatus of claim 41 including a high voltage ignition coil and an inductor interposed between said spark plug and said high voltage ignition coil so that approximately oscillation in the range between 100 and 600 MHz is produced by discharge of capacitive energy stored in said plug and approximately between 2 MHz and 20 MHz by discharge of capacitive energy stored in the capacitance of said coil discharging through said inductor.

45. In an electrical ignition system used for igniting air-fuel mixtures contained in a combustion chamber of an IC engine including at least one spark plug with a central high voltage conductor and an outer ground conductor containing a dielectric ceramic material interposed between said central conductor and said outer ground conductor, the improvement comprising means for providing maximum plug capacitance and minimum resistance to EM current in said spark plug by plating with high electrical conductivity material the ceramic surfaces of the portion of the said ceramic section interposed between said central and outer conductors.

46. The system defined in claim 45 wherein said high electrical conductivity material is from the group consisting of silver and copper, and the thickness of the plating on the outer ceramic surface is between 0.0002" (0.0005 cm) and 0.010" (0.025 cm).

47. The system of claim 45 wherein IC engine is a motor vehicle engine including at least one cylinder and piston with said spark therein, and said plug central conductor comprising a tip constructed and arranged such that under at least one normal cruise conditions of said vehicle the spark forms both to the back of the plug or plug shell and to the piston face during one spark plug firing.

48. The system defined in claim 45 wherein said central high voltage conductor of said spark plug has at least one diameter not less than 0.35" ($\frac{7}{8}$ cm) which is surrounded by dielectric insulating material of thickness between 0.1" and 0.12" (0.25 and 0.30 cm) and with relative dielectric constant greater than 8.0.

49. The system defined in claim 48 wherein said spark plug has protruding out of an outer shell ground conductor a central electrical conductor high voltage tip insulated along its length excepting for a bare metallic tip, i.e. an antenna plug tip, said insulated section of central conductor extending at least 0.2" (0.5 cm) beyond the outer shell ground conductor and wherein said spark plug tip and said outer plug ground conductor are further dimensioned and disposed such that the plug tip breakdown voltage is within the range of 8 to 32 Kilovolts under normal operating conditions of IC engine, and the system further including a multiple plusing CDC ignition for operating said plug wherein said plug tip defines a EM control volume characterized by the sequential production of spark pulses and high electric field pulses.

50. In an ignition system containing at least one spark plug, each such spark plug comprising means defining a conductive shell and a protruding central antenna conductor tip extending substantially beyond the spark plug shell of greater than 0.070" (0.175 cm) diameter and surrounded along part of its length with insulator of thickness about equal to tip diameter, the foregoing structure further defining a base gap "go" of at least 0.04" (0.1 cm), wherein said spark plug is mountable in a combustion chamber of an IC engine to define therein an EM Control Volume characterized by formation of both ignition spark and long duration high electric fields of strengths of at least 5000 volts/cm over at least a one cubic cm volume around said antenna tip.

51. The system defined in claim 50 including a CDC ignition system for producing multiple ignition pulses per ignition firing and said plug is mounted in a combustion chamber of an IC engine to ignite lean or other difficult to ignite mixtures, said CDC ignition designed to produce a train of sparking pulses including an initial ringing or closely spaced pulses followed by pulsus with larger spacings.

52. The system defined in claim 51 wherein said IC engine is a reciprocating IC engine and said plug tip defines a gap to the reciprocating member of said engine such that upon ignition firing sparks are formed to said plug shell and/or to said reciprocating member, and wherein the duration of said pulse train is reduced with engine RPM and wherein said pulse train includes "non-firing" pulses producing high electric fields within said EM Control Volume.

53. The system defined in claim 51 wherein said tip diameter is approximately 0.08" (0.2 cm), said insulator thickness is approximately 0.08" (0.2 cm) and said tip extends at least 0.2" (0.5 cm) beyond said shell to define "go" equal to approximately 0.05" (0.125 cm).

54. In an IC engine including at least one combustion chamber to which is mounted at least one spark plug and wherein each of said spark plugs are connected to at least one ignition coil, which ignition coil is part of a CD circuit with total secondary circuit high voltage capacitance Cs, the improvements comprising spark plug firing ends designed to provide a minimum spark breakdown voltage Vsm under normal operating engine conditions such that at least 5 millijoules are stored in Cs prior to breakdown and choke inductor interposed between high voltage terminal of said coil and high voltage terminal of said plug to control and tune discharge of secondary capacitances making up Cs and wherein inductance of said choke inductor is between 5 and 400 microhenries.

55. The system of claim 54 wherein said plug is a capacitance plug with capacitance greater than 20 pf and wherein in addition to said choke inductor there is a plug choke inductor disposed immediately at the high voltage connecting terminal of said spark plug.

56. System in accordance with any of claims 4, 36, and 41 in combination with means for providing an air-fuel mixture to said combustion chamber of at least 22:1 air-fuel ratio excepting under starting and high load conditions.

57. An ignition system for cyclically firing internal combustion engine with a varying combustion volume comprising (a) means for generating sequentially within said volume in each cycle of firing the following:
  (i) rapid, large gap electromagnetic energy current pulses of magnitude greater than 100 amps and delivering approximately 50 KWatts to the large gap at an operating frequency between 50 and 500 MHz,
  (ii) less rapid capacitive energy derived ignition pulses of magnitude greater than 20 amps and delivering approximately 10 KWatts to the large gap at an operating frequency between 1 and 50 MHz,
  (iii) much less rapid ignition pulses of approximately 4 amps peak current and delivering approximately 1 KWatt to the large gap at a frequency of approximately 10 KHz,
(b) antenna means for coupling said electromagnetic current pulses and high electric field pulses within an EM Control Volume of at least one cubic cm;
(c) means defining a large gap spark anchor of 0.16" to 0.32" (0.4 to 0.8 cm) relative to said antenna means contained within said EM Control Volume.

58. The system defined in claim 57 voltage required to form said large gap spark defines a "firing envelope" with voltage between 10 and 30 Kilovolts.

* * * * *